US010321787B2

(12) United States Patent
White

(10) Patent No.: US 10,321,787 B2
(45) Date of Patent: Jun. 18, 2019

(54) VERTICAL WALL MOUNT SYSTEM

(71) Applicant: Richard White, Camarillo, CA (US)

(72) Inventor: Richard White, Camarillo, CA (US)

( * ) Notice: Subject to any disclaimer, the term of this patent is extended or adjusted under 35 U.S.C. 154(b) by 0 days.

(21) Appl. No.: 14/985,090

(22) Filed: Dec. 30, 2015

(65) Prior Publication Data

US 2016/0183736 A1 Jun. 30, 2016

Related U.S. Application Data

(60) Division of application No. 14/308,342, filed on Jun. 18, 2014, which is a continuation of application No. PCT/US2013/022548, filed on Jan. 22, 2013.

(Continued)

(51) Int. Cl.

| | |
|---|---|
| ***A47K 3/04*** | (2006.01) |
| ***A47K 3/16*** | (2006.01) |
| ***A47K 3/28*** | (2006.01) |
| ***E04B 2/02*** | (2006.01) |
| ***E04B 2/58*** | (2006.01) |
| ***E04H 4/00*** | (2006.01) |
| ***E04F 13/08*** | (2006.01) |
| ***E04F 13/09*** | (2006.01) |
| ***E04F 13/24*** | (2006.01) |
| ***E04F 19/02*** | (2006.01) |

(52) U.S. Cl.

CPC ..... *A47K 3/16* (2013.01); *A47K 3/04* (2013.01); *A47K 3/283* (2013.01); *E04B 2/02* (2013.01); *E04B 2/58* (2013.01); *E04F 13/0805* (2013.01); *E04F 13/09* (2013.01); *E04F 13/24* (2013.01); *E04F 19/02* (2013.01); *E04B 2002/0202* (2013.01); *E04H 4/0043* (2013.01)

(58) Field of Classification Search

CPC .. A47K 3/16; A47K 3/283; A47K 3/04; E04B 2/02; E04B 2/58; E04B 2002/0202; E04F 13/0805; E04F 13/09; E04F 13/24; E04F 19/02

See application file for complete search history.

(56) References Cited

U.S. PATENT DOCUMENTS 3,621,635 A * 11/1971 De Lange ..... E04F 13/083 29/460
3,791,096 A * 2/1974 Epperlein ..... E04B 2/58 24/546

(Continued)

*Primary Examiner* — Brian E Glessner
*Assistant Examiner* — Omar F Hijaz
(74) *Attorney, Agent, or Firm* — Avyno Law P.C.

(57) ABSTRACT

A vertical wall mount system is provided that is easily installed in a perfectly level and plumb manner and is further cable of being design to be completely waterproof, interchangeable and customizable to include endless additional features. The vertical wall mount system includes two main components: a sub-frame assembly and a panel frame assembly. The sub-frame assembly includes mounting clips for pivotal attachment to a wall frame, such as, a standard 2×4 stud. Horizontal wall rails are mounted on the mounting clips to create the sub-frame assembly. The horizontal wall rails are designed to support a panel assembly on the horizontal wall rails, which may, for example, include a tile panel. The panel assembly includes a panel frame secured to the back side of the panel, which panel assembly is designed to hang on the horizontal wall rails of the sub-frame assembly.

2 Claims, 22 Drawing Sheets

Related U.S. Application Data

(60) Provisional application No. 61/637,307, filed on Apr. 24, 2012, provisional application No. 61/588,606, filed on Jan. 19, 2012.

(56) References Cited

U.S. PATENT DOCUMENTS

| | | | | | |
|---|---|---|---|---|---|
| 4,625,481 | A * | 12/1986 | Crandell | E04F 13/0889 | 52/235 |
| 4,765,108 | A * | 8/1988 | Lapish | E04B 1/41 | 248/231.91 |
| 4,817,538 | A * | 4/1989 | Michaelsen | A47B 57/34 | 108/108 |
| 5,063,721 | A * | 11/1991 | Larsson | E04B 2/86 | 211/106 |
| 6,267,339 | B1 * | 7/2001 | Gates | H01Q 3/06 | 248/218.4 |
| 7,909,297 | B1 * | 3/2011 | Harris | A47B 83/04 | 248/220.21 |
| 2010/0186333 | A1 * | 7/2010 | Miller | E04F 13/14 | 52/483.1 |

* cited by examiner

VERTICAL WALL MOUNT SYSTEM

CROSS-REFERENCE TO RELATED APPLICATIONS

This application is a divisional of and claims priority to U.S. patent application Ser. No. 14/308,342, filed on Jun. 18, 2014 titled VERTICAL WALL AMOUNT SYSTEM, which claims priority to International Patent Application Serial No. PCT/US13/22548, filed Jan. 22, 2013, titled VERTICAL WALL MOUNT SYSTEM, which claims priority to U.S. Provisional Patent Application Ser. No. 61/637,307 filed Apr. 24, 2012 and U.S. Provisional Patent Application Ser. No. 61/588,606 filed Jan. 19, 2012, all of which applications are incorporated by reference into this application.

FIELD OF THE INVENTION

This invention is related to a wall mount system, and in particular, a framing system that permits the mounting of vertical substrates, such as panels, directly onto the frame structure for ease in installation and replacement.

BACKGROUND OF THE INVENTION

Traditional construction methods make it very difficult to install and remodel bathrooms, and in particular, to install and remodel tubs and showers. Tiling a bathroom shower in a custom shower installation takes a great deal of time, skill and patience, using methods of on-site fabrication that have changed little over several decades. The process is very labor intensive, slow and is an imperfect process due to leveling issues created by settling, misalignment and unleveled floors and walls in existing construction.

Using conventional methods, construction of a home bathroom or a remodel first comprises a shell of 2×4 framing. To this frame, waterproof building paper followed by a cement wallboard is anchored to the wall by mechanical fasteners. These fasteners penetrate directly through the waterproof building paper and the cement wallboard, creating potential leak hazards. Problems causes by leaks and cracks do not show up until years after the work is completed. The principal such problem being the growth of mold caused by water leaks in cracks in the tile, or in the joints between tiles, which allow mold to grow in the wallboard under the tile. In these cases, the water intrusion is primarily due to movement of the house caused by settling and natural expansion and contraction of the building materials as the seasons pass and/or improperly installed tile and waterproofing.

Further, to the cement wallboard, hundreds of individual tiles are cemented with each joint being grouted to prevent water intrusion behind the wall board. Presently, several days are required to fully tile a tub or shower enclosure. Where mosaic patterns or designs are desired, or where the location of the project is not in close proximity to a suitable area to place and saw time, the length of time required to finish the tile installation increases substantially. As such, installing or remodeling a new shower or tub can take several weeks, during which time the homeowner is left without the use of his or her bathroom, creating a separate problem for the homeowners.

Further, many problems exist with traditional on-site tiling of shower and bath enclosures. Most new homes are framed with "green" lumber, which often have moisture content as high as 70%. This lumber eventually dries out and the moisture content is reduced to under 20% depending upon local conditions. During this process the lumber slowly begins to twist and bow. Therefore, in conditions where the underlying cement wallboard is secured directly to the framing members, (i.e. the 2×4 studs). The wallboard will bow or flex as the 2×4 studs move. This movement of the underlying wall board causes cracks to form in the tiles and grout joints and, in some instances, the tiles will loosen and fall off. In either case, the risk of moisture penetrating these cracks and causing damage to the home is greatly increased and greatly increases the potential for leaks and mold. Furthermore, the current method of installation for heavy glass enclosures is also laborious and adds problems. It is only after the tile installation is complete that the glass can be measured and ordered. This is due to the imprecise methods of tile setting currently used and the fact that the glass panels must fit with strict tolerances. When anchoring the hardware, (consisting of a combination of hinges, clips, U-channels or headers) the installer must drill all the way through the tile, compromising the waterproofing and risking cracking the tile.

Further, once installed, it is difficult to access the wall area behind the tile without demolishing the existing wall. Needs often arise for accessing the area behind the wall. For example, for purposes of changing or repairing fixtures, access behind the tile walls is often times necessary. This requires partially demolishing the existing tile wall and then replacing the destructed area. Demolition is also needed to update or change the ornamental tile appearance or to replace the tub. Thus, traditional installations methods create a closed environment that make access behind the wall panels virtually impossible without demolishing at least a portion of the existing structure and remodeling the structure once the repair or update is complete.

Yet another problem existing when the remodel requires the inclusion of a heavy unit or subunit, such as a heavy glass door. In this case, the heavy unit or subunit may need to be mounted directly to the studs to support the load of the unit. In some cases, additional framing behind the wall is required to support the heavier structures. Thus, in addition to demolition, framework is sometimes also required to support the load of the remodeled system or unit.

Numerous attempts have been made to avoid this labor intensive task of tiling bathrooms. The most successful to date are likely those where bathtubs and/or showers with approximately ⅔ height walls are prefabricated from fiberglass, sheet molding compound or like materials. These prefabricated shower and/or bath installations are typically made in an offsite facility and are shipped to the job site for installation. Though less costly than a custom tile installation, prefabricated shower/bath units of the type described are less aesthetically pleasing than a tiled installation, and because they are typically made from hand laid fiberglass in a mold are themselves still fairly labor intensive to install. Additionally, the fiberglass tub and shower surrounds do not provide enough support to install heavy glass frameless showers.

As may be seen, there remains a need in the art for a system that reduces or eliminates the time and cost associated with water-proofing and tiling shower and/or bathtub walls in bathrooms and any other room or structure where tiles are desired. A need further exists for wall installation method and system that allows one to create perfectly plumb, perfectly square walls out of an imperfect structure. A further need exists for system that is waterproof, adaptable, interchangeable and capable of allowing access to the wall area behind the tile panels without compromising the integrity of the structure or requiring extensive remodeling to gain access to the area behind the tile. A further need exists for a system that allows for movement of the studs and flooring without compromising the integrity of the system or cracking the tiles or grout. Yet another exists for a system that permits the unit to be updated quickly and easily, without great expense or remodel. A cost effective, inexpensive, easily installable, interchangeable wall mount system is needed for construction in locations, such as in a bathroom shower.

SUMMARY

A vertical wall mount system is provided that is easily installed in a perfectly level and plumb manner and is further cable of being design to be completely waterproof, easily interchangeable and customizable. The vertical wall mount system includes two main components: a sub-frame assembly and a panel frame assembly. The sub-frame assembly includes mounting clips for pivotal attachment to a wall frame, such as, a standard 2×4 stud. Horizontal wall rails are mounted on the mounting clips to create the sub-frame assembly. The horizontal wall rails are designed to support a panel assembly on the horizontal wall rails, which may, for example, include a tile panel. The panel assembly includes a panel frame secured to the back side of the panel, which is designed to hang on the horizontal wall rails of the sub-frame assembly.

The panel frame and panel together form the panel assembly. The perimeter of the panel frame may interlock and or overlaps with other adjacent panels. A compression gasket may be utilized to create a water-tight seal. All the frame members, including the horizontal wall rails and panel frame, including the perimeter frame, may be constructed of aluminum. And, the panel, forming part of the panel assembly, may, in some examples, be constructed of a polycarbonate wall material, cut to size as needed, which is attached to the panel frame. The polycarbonate wall material may include tile mounted thereon, or include other decorate designs, as well as other features, that may be customized for particular applications.

The vertical wall mount system of the invention allows for the installation of modular panels on vertically framed wood, iron stud walls or continuous wall surfaces. The mounting clips of the invention can be adapted for attachment to wooden framing and another for a continuous wall surface. The vertical wall mount system may further include an installation tool that accurately and quickly aligns the horizontal wall rails of the sub-frame, thereby allowing for the rapid installation of the horizontal wall rails and, of the entire system.

Since the system can create a waterproof environment and because light can pass through the polycarbonate wall material, lighting and electrical equipment, include television, computers, tablets, infotainment systems and similar components and devices, may be placed behind the panel assembly. As the panel assembly is interchangeable, access to the frame, plumbing and electrical behind the panel assembly for maintenance, repair and updating is easy. Further, as the panel assembly is customizable, the assembly may be designed with fasteners and connectors built into the panel for adding additional structural features to the unit, after or during installation. Further, component features may also be designed directly into the panels, such as carve outs, shelves, etc.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

As illustrated in FIGS. 1-17, the invention relates to a vertical wall mount system can be utilized to finish all of part of the walls of a room in the state of a framed shell. The vertical wall mount system of the invention is particularly useful in constructing or remodeling shower units. While FIGS. 1-17 illustrate the use of the vertical wall mount system in connection with a tub and shower unit 100 (FIG. 1), those skilled in the art will recognize that the invention may be utilized in connection with the mounting of any vertical substrate to an existing frame structure, whether the existing structure be a wood frame, solid concrete wall, combination thereof, or other known frame type. For example, the vertical wall mount system of the invention can be used to install standard wall construction, splash boards, panel assemblies of any type, in-wall mounted units, such as TVs or other appliances, any walled units requiring waterproofing (e.g., for the placement of electronics behind a wall in a wet environment), or other vertical surfaces that require precision and ease in installing level and plumb vertical mounts to a frame.

Those skilled in the art will also recognize that the vertical wall mount of the invention is applicable to new construction, as well as to maintenance, repair or remodeled construction. The system is not limited to bathrooms or to any particular type of room, nor is the system limited to tiled walls. Rather, the system is one of general applicability and is suitable for use in any building where the interior or exterior shell requires finishing or where it is desired to use wall panels, such as tile wall panels, that may easily be removed and replaced.

It will be understood that terms such as "communicate," "interface" or "interconnect" (for example, a first component "communicates with" or "is in communication with" a second component) are used herein to indicate a structural, functional, mechanical relationship between two or more components or elements. As such, the fact that one component is said to communicate with a second component is not intended to exclude the possibility that additional components may be present between, and/or operatively associated or engaged with, the first and second components.

Figure 4:
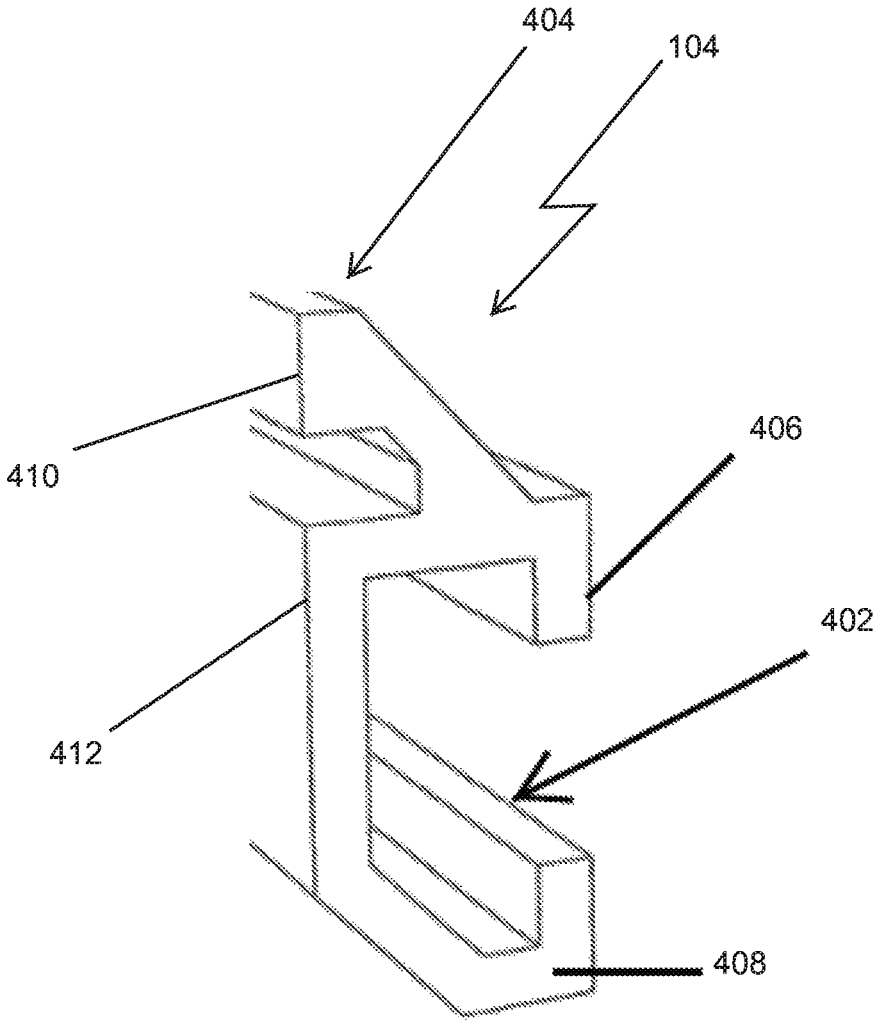
FIG. 4 is a cross-section of the horizontal wall rail of the sub-frame assembly taken along line A-A of FIG. 1.
Figure 5:
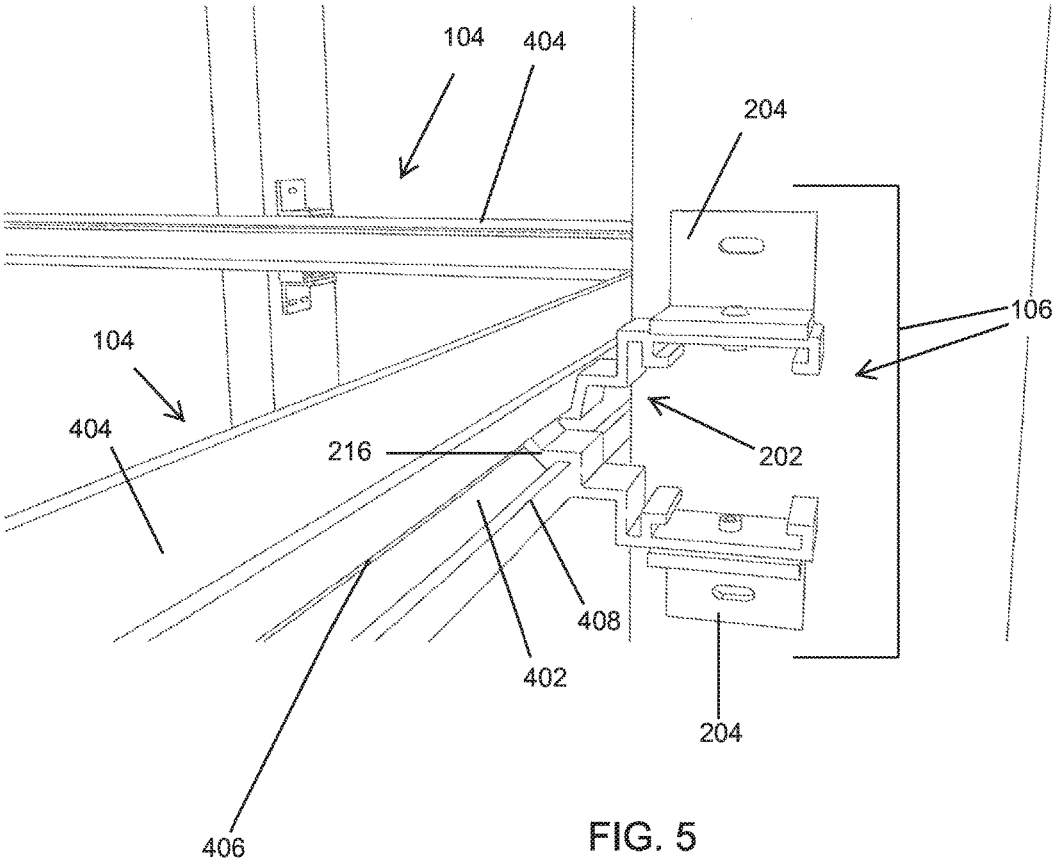
FIG. 5 is a rear perspective review of the sub-frame illustrating the horizontal wall rail engaged with a mounting clip.
Figure 6:
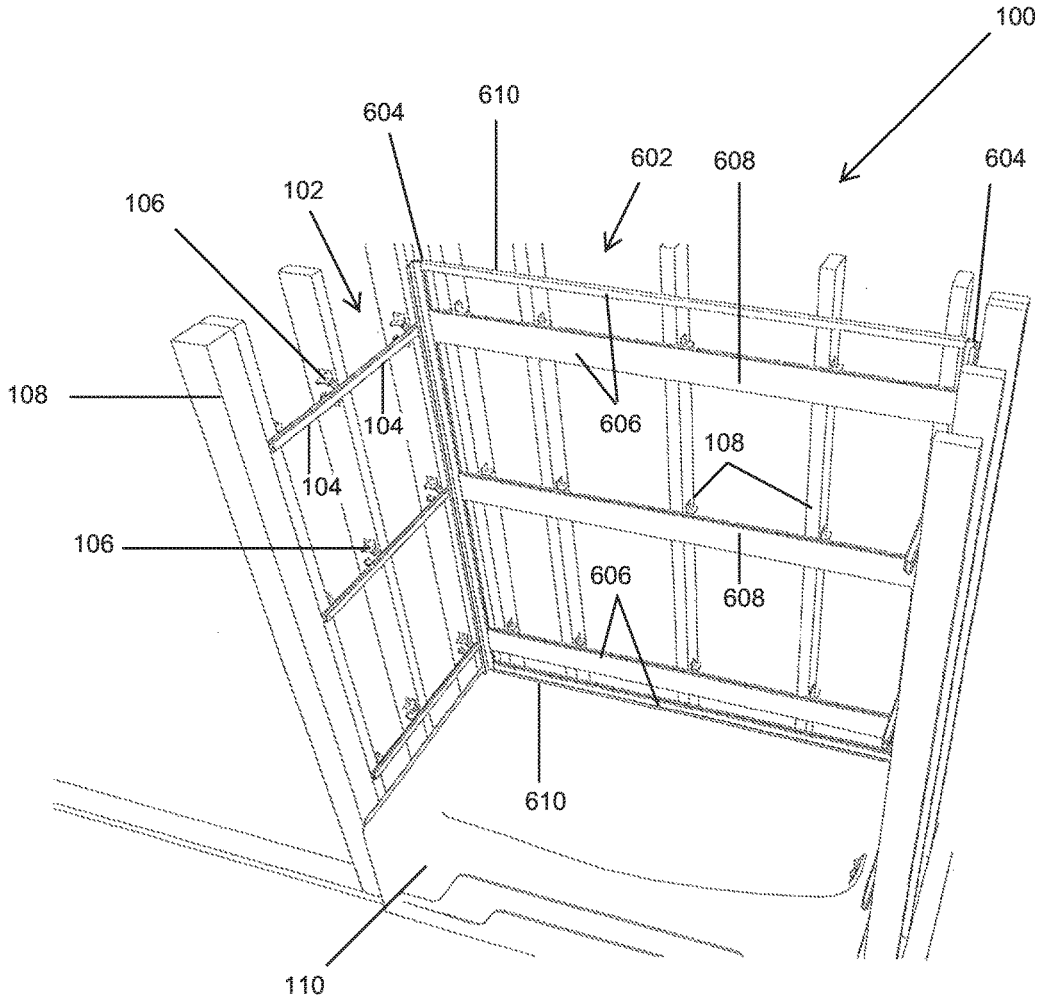
FIG. 6 is a perspective view of a tub and shower unit having all the drywall and tile surrounding the tub removed illustrating the panel frame of the panel frame assembly of the vertical wall mount system of the invention mounted to the rear wall of the unit.
Figure 9A:
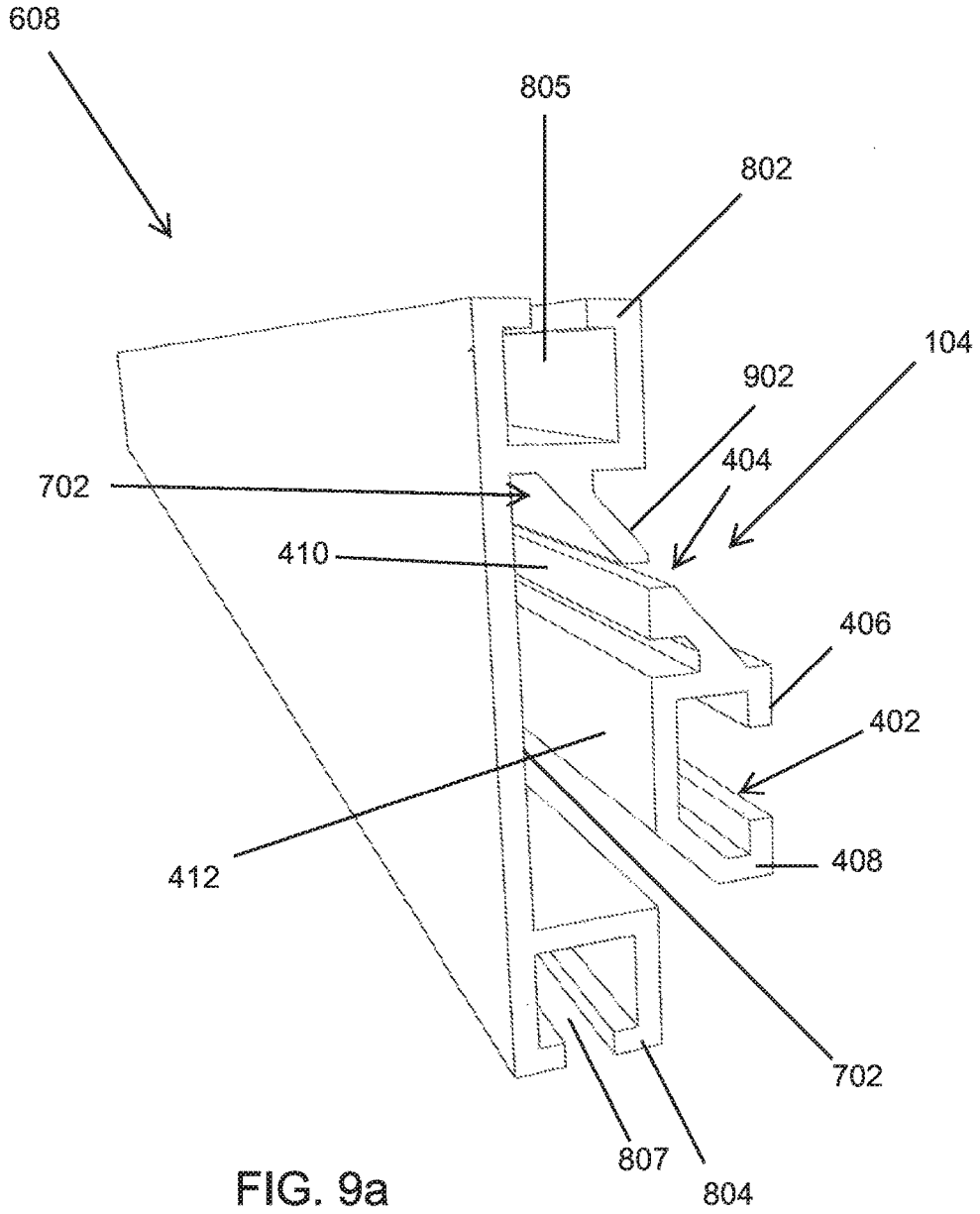
FIG. 9*a* is a cross-section of a horizontal panel rail aligned with the horizontal wall rail prior to placement of the panel frame on the sub-frame assembly.
Figure 9B:
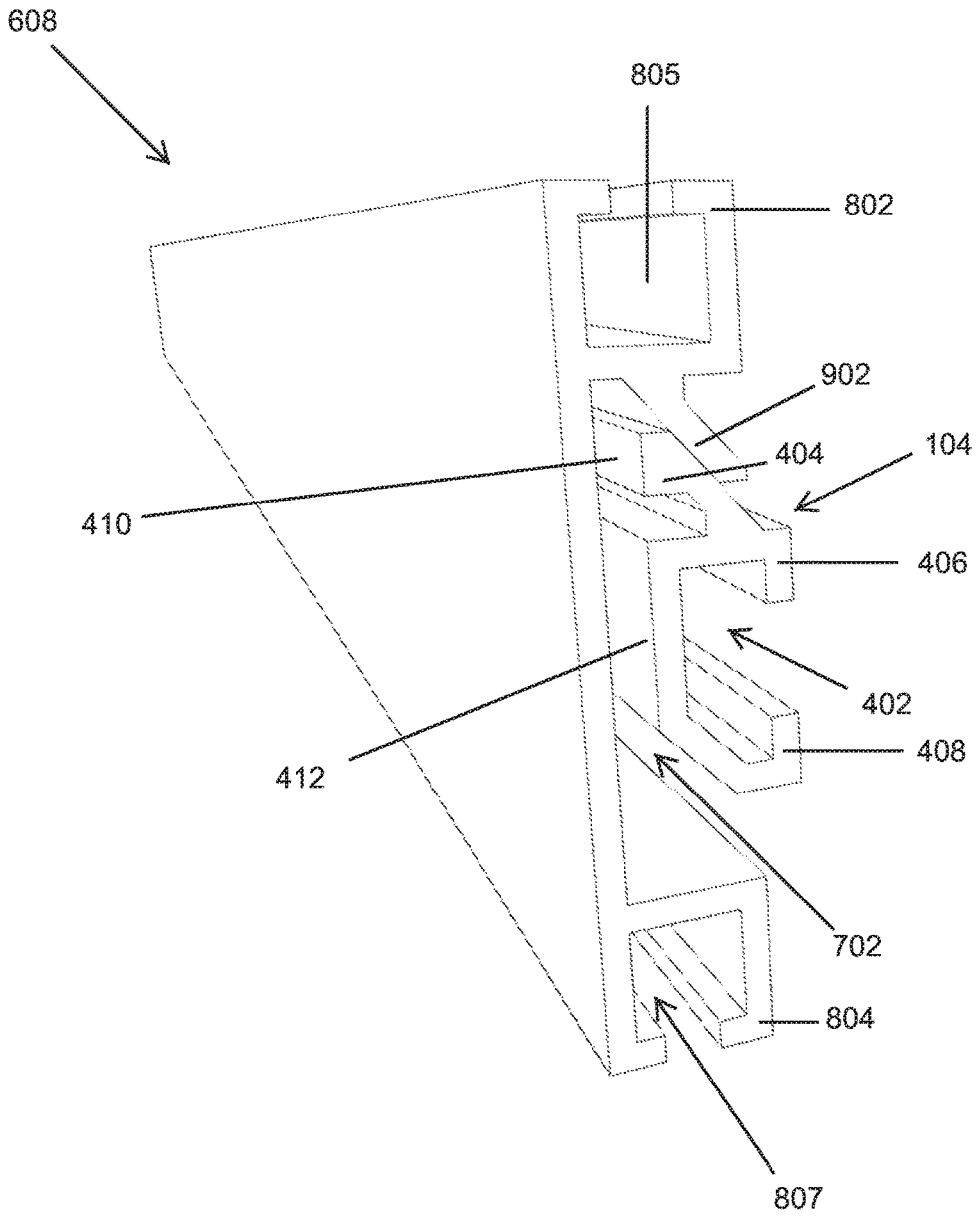
FIG. 9*b* is a cross-section of the horizontal panel rail of the panel frame as it is being placed upon the horizontal wall rail of the sub-frame assembly.
Figure 9C:
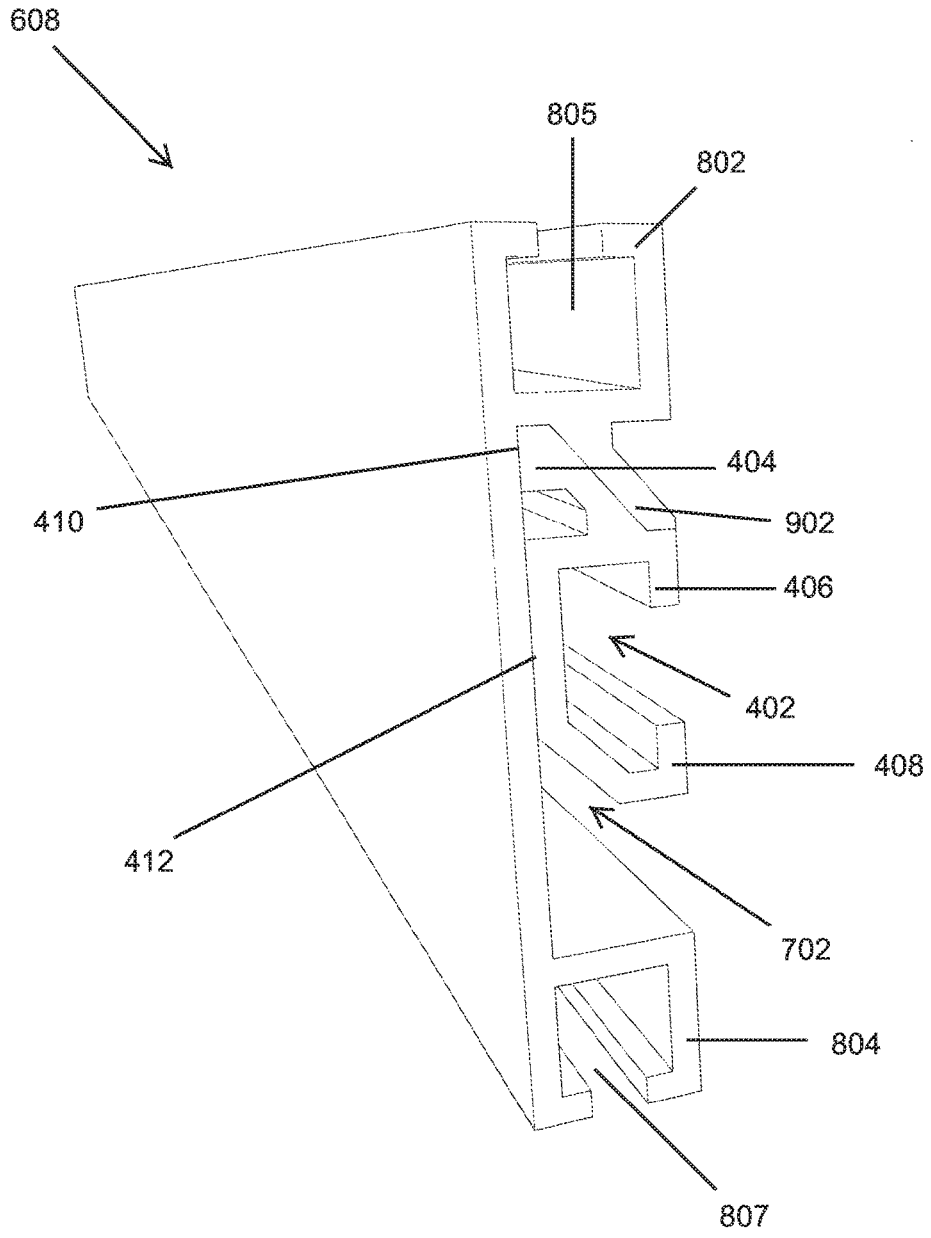
FIG. 9*c* is a cross-section of the horizontal panel rail of the panel frame placed on the horizontal wall rail of the sub-frame assembly.
Figure 10:
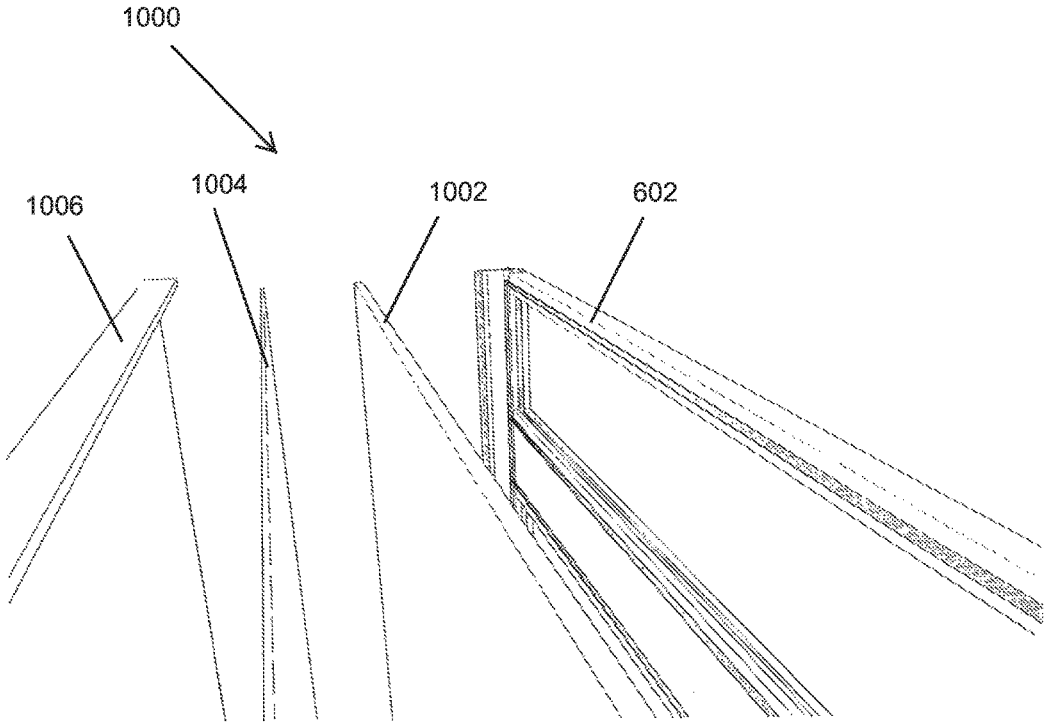
FIG. 10 is an exploded plan perspective view of one example of a panel utilized in connection with the panel frame assembly.
Figure 11:
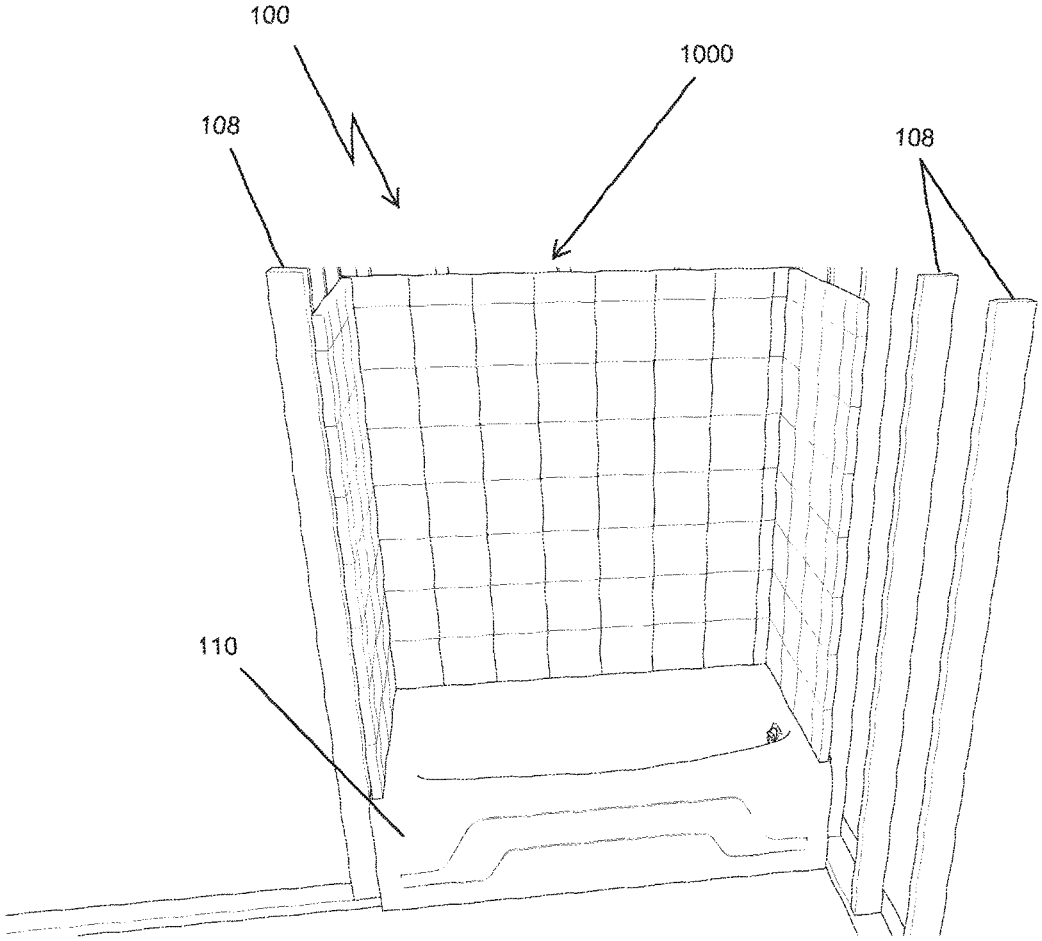
FIG. 11 is a perspective view of a tub and shower unit having the panel assembly installed on the sides walls of the tub utilizing the vertical mount wall system of the invention.
Figure 12:
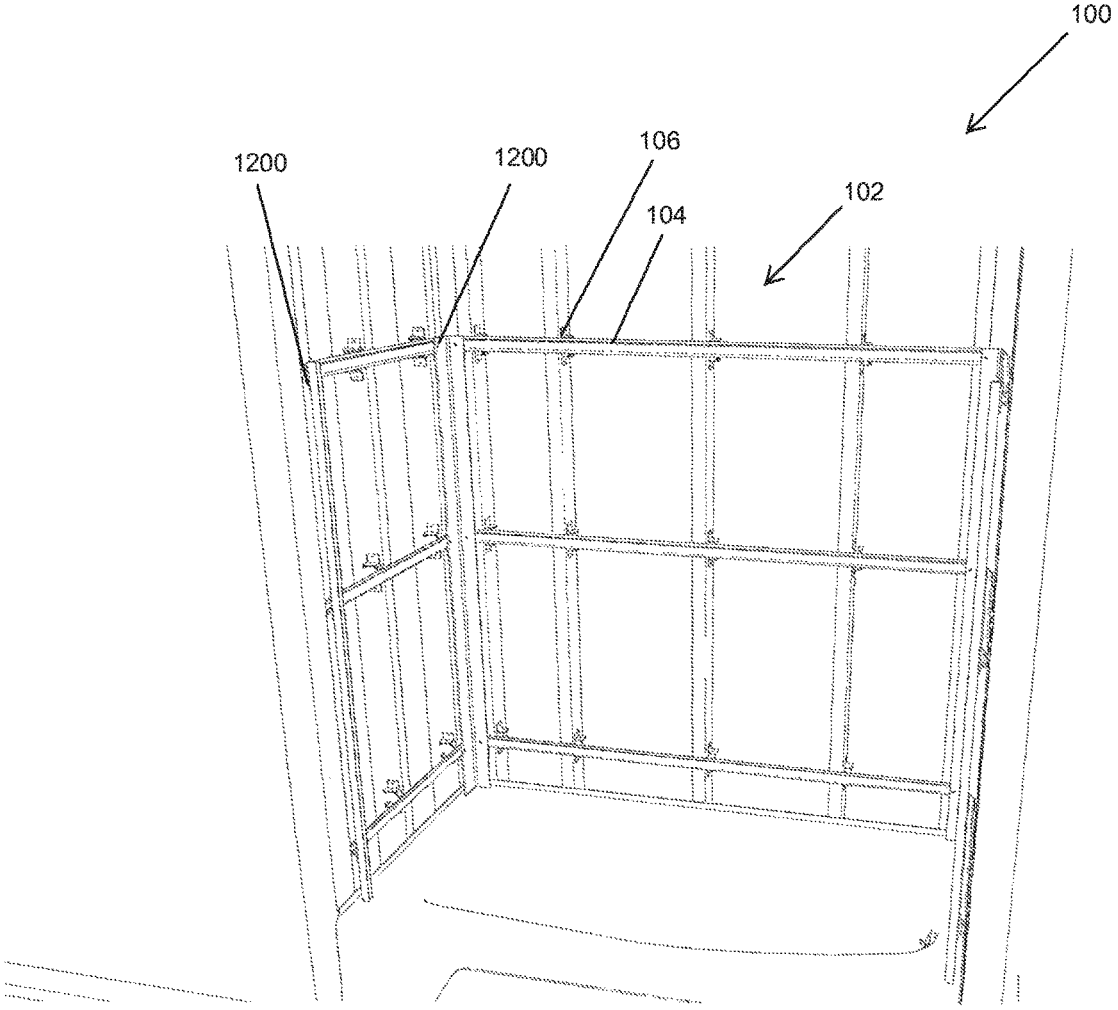
FIG. 12 is a front view of the sub-frame assembly mounted to the studs surrounding a tub utilizing a basic installation tool.
Figure 13:
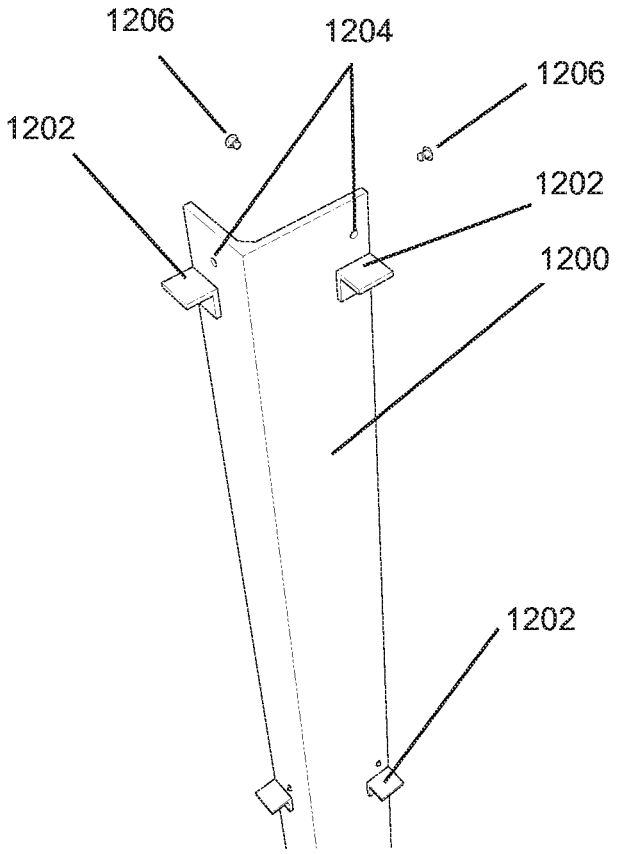
FIG. 13 is a rear perspective view of the top portion of the basic installation tool.
Figure 14:
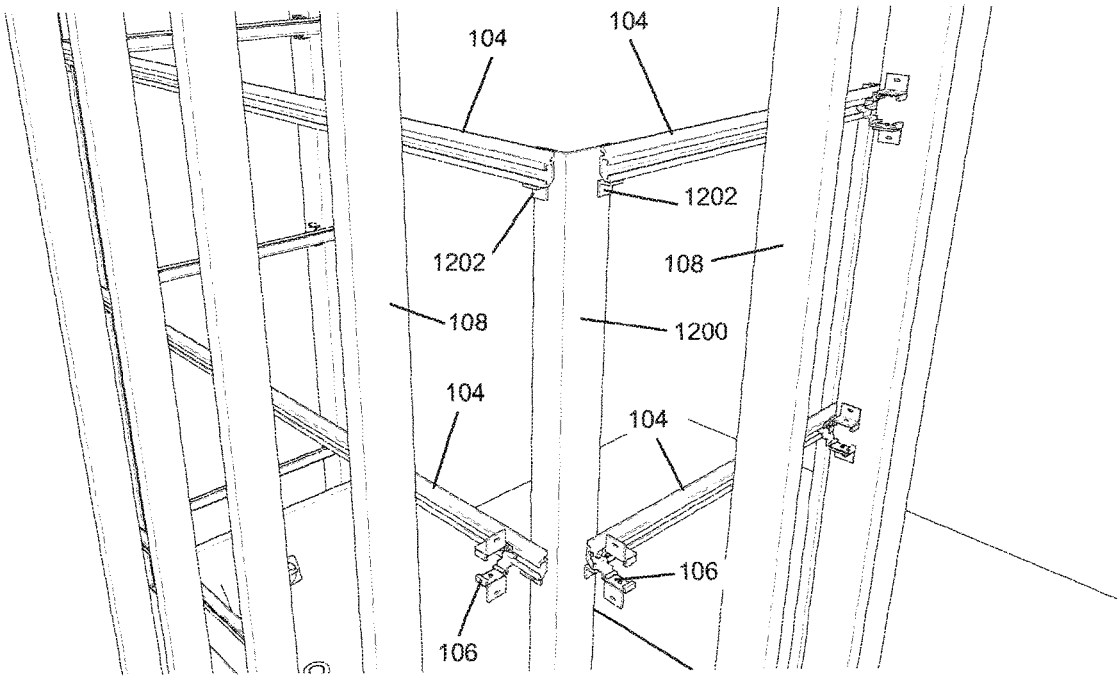
FIG. 14 illustrate a back view of the sub-frame assembly being mounted on the studs surrounding the tub utilizing a basic installation tool.
Figure 16:
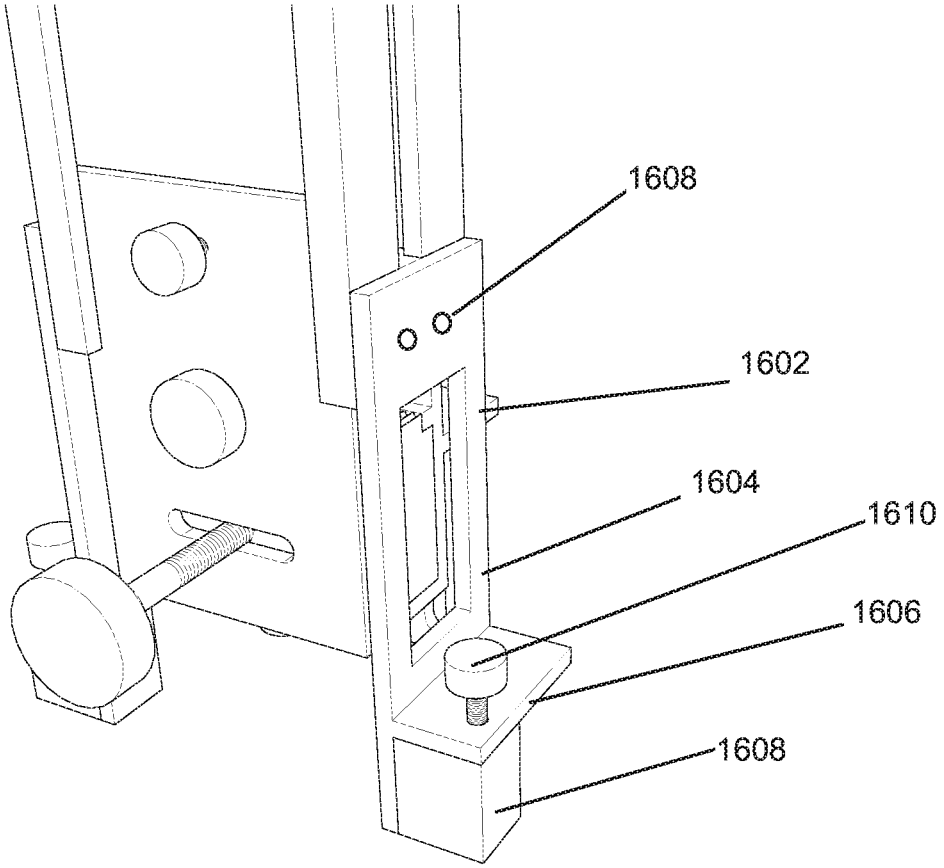
FIG. 16 is a close-up view of the encircled portion A of FIG. 15*a*, which illustrates one bottom end adjustment portion of the enhanced installation tool of FIG. 15*b*.
Figure 17:
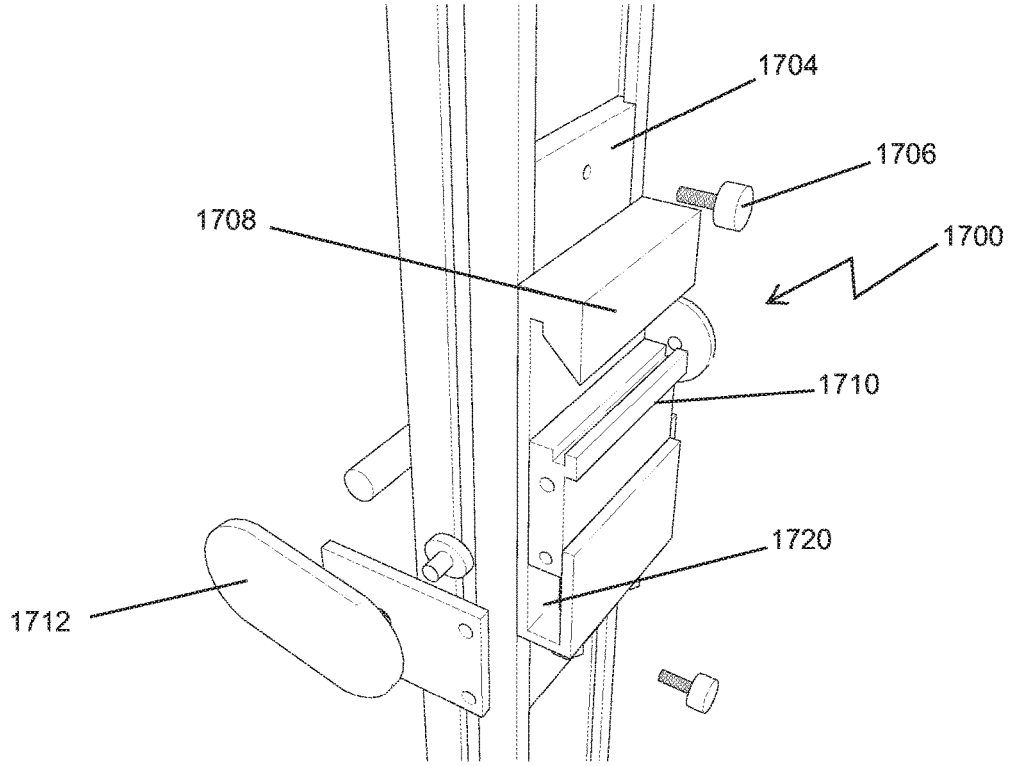
FIG. 17 is a close-up view of the encircled portion B of FIG. 15*a*, which illustrates one central adjustment portion of the enhanced installation tool of FIG. 15*a*.

As illustrated in FIGS. 1-11, the vertical wall mount system of the invention consists of two main components: the sub-frame assembly 102 (FIG. 1) and the panel frame assembly 602 (FIG. 6). FIGS. 1-5 illustrate the various components of the sub-frame assembly 102 and FIGS. 6-10 illustrate the various components of the panel frame assembly 602. FIG. 11 illustrates the complete structure as it would appear after being installed in a shower tub unit 100. The remaining FIGS. 12-14 illustrate the installation of the sub-frame assembly 102 using a standard installation tool 1200, while FIGS. 15-17 illustrate the installation of the sub-frame assembly 102 using an enhanced installation tool 1500. The use of the installation tools 1200, 1500 make it easy to level and plumb the sub-frame assembly 102 against the frame.

For exemplary purposes only, FIGS. 1-17 refer to a bathroom, which framing in residential construction will typically consist of 2×4 studs 108 made of wood. Commercial construction will more typically be framed with steel studs. The system of the present invention is applicable to both types of construction. Electrical wiring and outlet boxes and plumbing connections are generally installed after construction of the shell but before finishing of the room. To simplify the understanding of the invention, the electrical wiring and plumbing are not shown in the illustrated examples.

Figure 1:
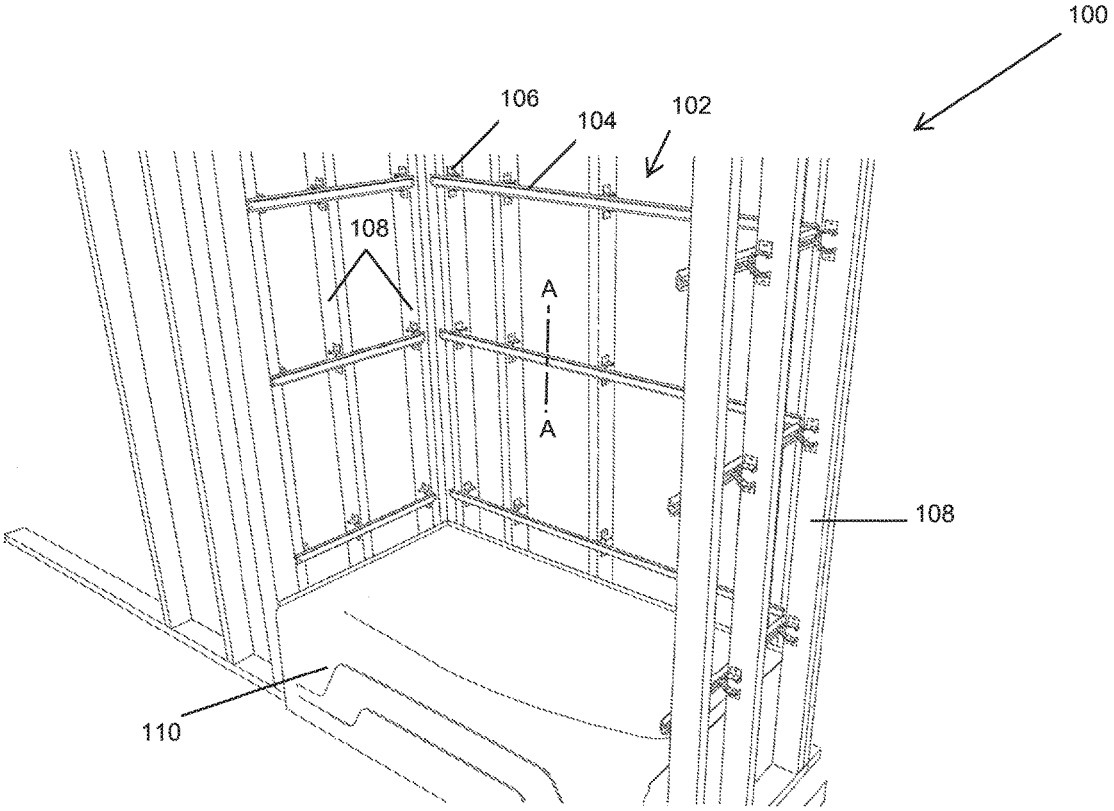
FIG. 1 is a perspective view of a tub and shower unit having all the drywall and tile surrounding the tub removed illustrating the sub-frame assembly of the vertical wall mount system of the invention mounted to the surrounding framing studs.

Turning now to FIG. 1, FIG. 1 is a perspective view of a tub and shower unit 100 having all the drywall, concrete wallboard, waterproofing patent, and tile surrounding the tub 110 removed. FIG. 1 further illustrates the sub-frame assembly 102 of the vertical wall mount system of the invention mounted to the surrounding framing studs 108. As shown, most shower units 100 are constructed on a standard framing structure having 2×4 stud construction. Those skilled in the art recognize that when finishing a bathroom, a tub 110 or shower pan will first be installed. It is thereafter that the vertical wall mount system of the invention is applied.

In the case of a remodel, once the drywall and/or concrete board are stripped from the surrounding tub walls, the sub-frame assembly 102 is then anchored to the stud walls 108. The sub-frame assembly 102 consists of two main components: horizontal wall rails 104 and mounting clips 106. The mounting clips 106 are mounted directly to the studs 108. Once the mounting clips 106 are mounted on the studs 108, the horizontal wall rails 104 are then interconnected with the mounting clips 106, which in one implementation, is accomplished by sliding the horizontal wall rails 104 onto the mounting clips 106.

Figure 2:
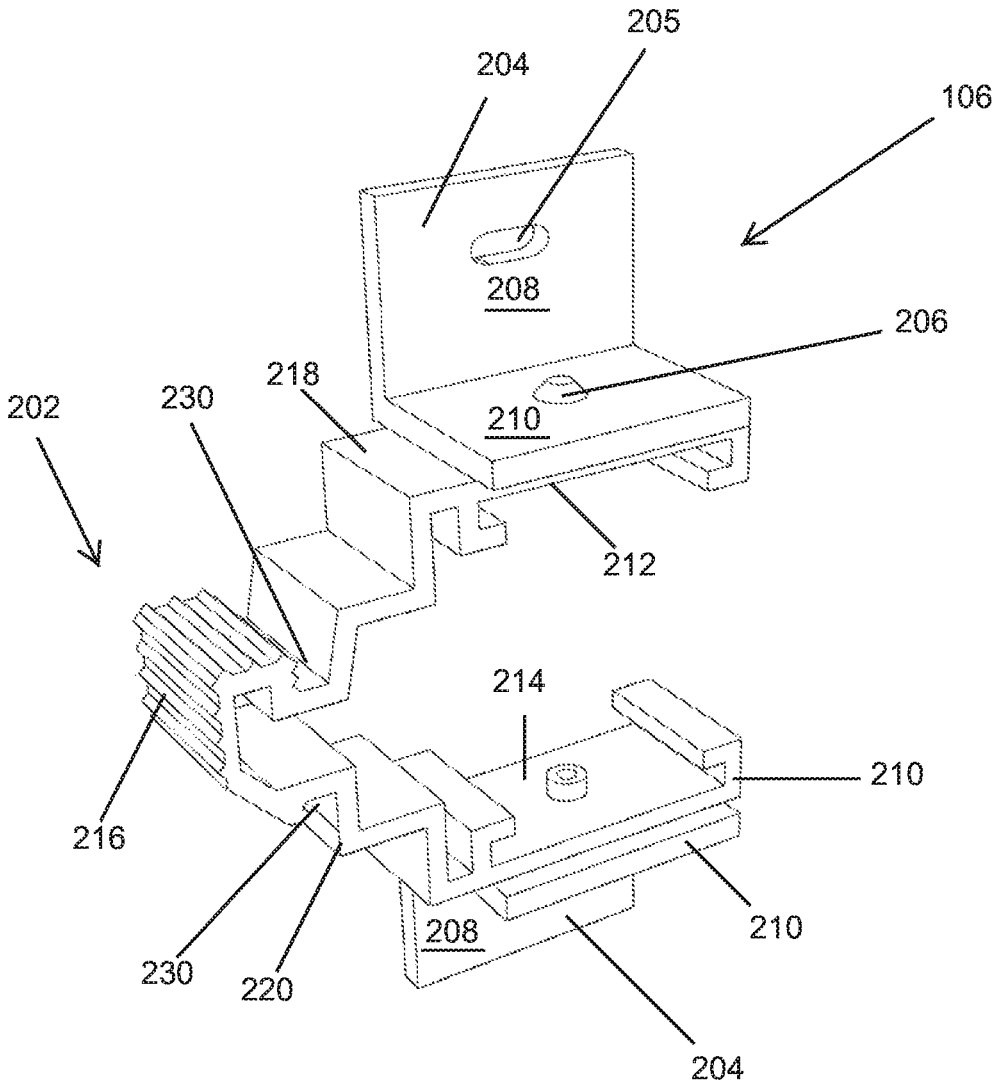
FIG. 2 is a perspective view of the mounting clip of the sub-frame assembly.

FIG. 2 is a perspective view of the mounting clip 106 of the sub-frame assembly 102. As illustrated in FIG. 2, the mounting clips 106 include three main components: top and bottom L-shaped brackets 204 and a central mounting member 202. The central mounting member 202 is a generally C-shaped bracket mounted to the studs 108 using L-shaped brackets 204. The L-shaped brackets 204 each have two legs 208 and 210 positioned in perpendicular alignment with one another. A first leg 208 may be mounted direction to a stud 108, while the second leg 210 of the L-shaped bracket 204 may be mounted to the central mounting member 202. The first leg 208 includes at least one opening 205 for mounting the L-shaped bracket 204 directly to a stud 108. The opening 205 may be a slot to provide adjustability inwardly or outwardly along the face of the stud 108. This adjustability allows each horizontal wall rail 104 of the sub-frame assembly 102 to be installed coplanar with every other mounting clip 106 on the same wall frame.

The second leg 210 of the L-shaped brackets 204 has an opening 207 (FIG. 3) for receiving a fastener 206, such as a rivet, to connect the L-shaped bracket 204 to the central mounting member 202 in a pivotal manner. The mounting clips 106 are designed such that they pivot relative to the studs 108 to which they are mounted. This allows for the horizontal wall rails 104 to remain plumb against the frame regardless of any misalignment of the studs 108 or later shifting of the studs 108 after installation of the vertical wall mount system.

Central mounting member 202 includes top and bottom mounting platforms 212 and 214, respectively, for seating against and pivotally securing the central mounting member 202 to the L-shaped brackets 204. The central mounting member 202 further includes upper and lower stair stepped or angled extension portions 218 and 220 for extending the central portion of the central mounting member 202 outward and beyond the front edges of the studs 108. This permits the engagement of the central mounting member 202 with the horizontal wall rails 104 without interference with the studs 108. In the illustrated example, the central most portion of the central mounting member 202 includes a channel insert for engagement with the horizontal wall rails 104, which in the illustrated example, takes the form of a modified dovetail 216; however, those skilled in the art will recognize that other shapes designed to mate with the rear channel in the horizontal wall rail 104 may be utilized. Further, it is recognized that the mating configuration may be reversed such that the mount clips 106 include channels for receiving channel inserts on the rear of the horizontal wall rails 104. The reverse mating configuration would be an equivalent structure for purposes of the invention.

Figure 3:
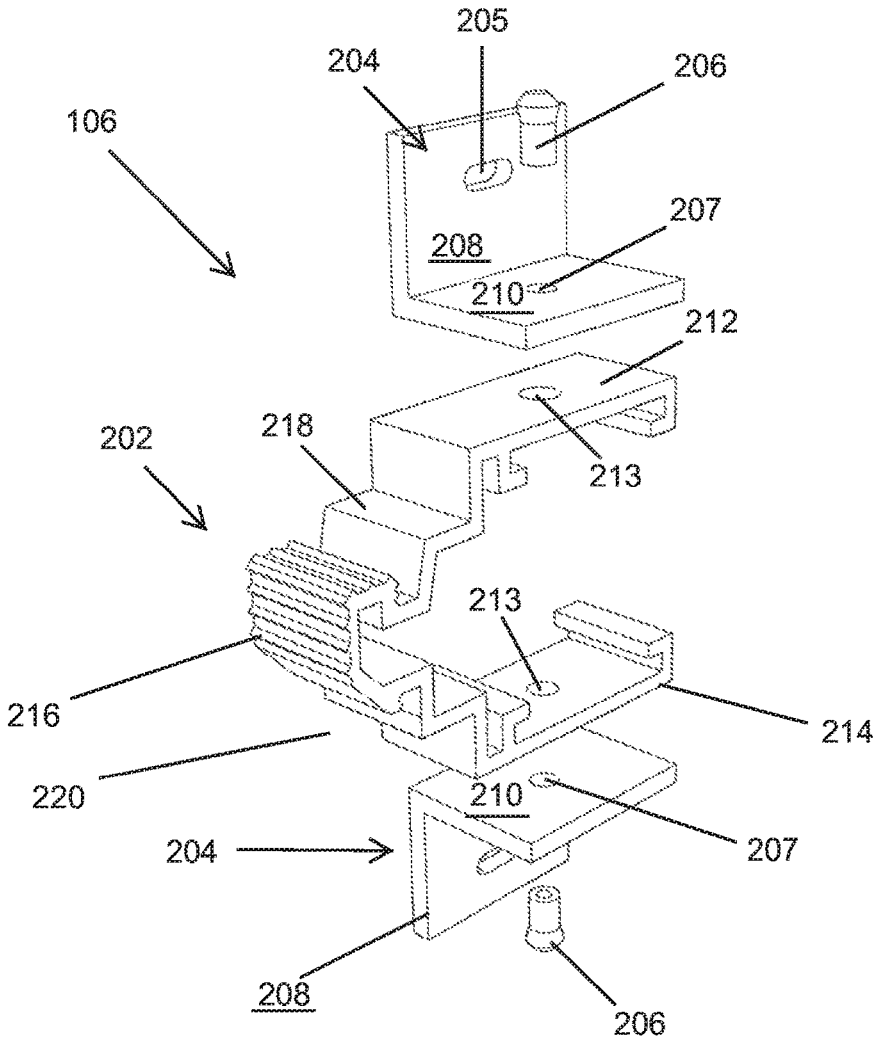
FIG. 3 is an exploded view of the mounting clip of FIG. 2.

FIG. 3 is an exploded view of the mounting clip 106 of FIG. 2. FIG. 3 best illustrates the interconnection of the L-shaped brackets 204 with the central mounting member 202. As seen in FIG. 3, both first legs 208 of the L-shaped brackets 204 have openings 205 for receiving a fastener to attach the L-shaped brackets 204 to the studs 108. The L-shaped brackets 204 further include openings 207 on their second legs for receiving a fastener 206 to attach the L-shaped brackets 204 to the central mounting member 202. Similar to the L-shaped brackets 204, the central mounting member 202 on its top and bottom mounting platforms 212, 214 includes openings 213 for receiving the fastener 206. The fastener 206 utilized to secure the parts together is one that is design to pivotally mount the L-shaped brackets 204 to the central mounting member 202. The L-shaped brackets 202 are pivotally connected to the central mounting member 202 to allow the central mounting member 202 to pivot relative to the studs 108 to which they are mounted. This allows the horizontal wall rails 104 attached to the mounting clips 106 to remain plumb despite misalignment of the studs 108 during installation or due to bowing, warping or movement of the studs 108 post installation, due to moisture or settling.

While the figures illustrate the mounting clips 106 attached to the sides of the 2×4 studs 108 along the 4 inch length of the studs 108, those skilled in the art will recognize that a mounting clip of similar construction can be utilized to mount onto a flat wall (e.g. a concrete wall) or onto the front of a stud 108 along the 2 inch thickness. This is accomplished by rotating the L-shaped brackets 204, ninety degrees relative to the central mounting member 202. Further, in order to create less space between the horizontal wall rail 202 and the front surface of the studs 108 or wall to which the mounting clips 106 are attached, the central mounting member 202 can be constructed to be shallower in design. For example, the upper and lower extension portions 218 or 220 can be eliminated or minimized.

As illustrated in connection with FIG. 4 and FIG. 5 below, the horizontal wall rails 104 includes channels 402 on their rear or back surface for receiving the corresponding modified dovetail 216 of the central mounting member 202 of the mounting clip 106. As explained further below, in the illustrated example, the dovetail 216 is designed to fit within the channel 402 of the horizontal wall rail 104 such that the horizontal wall rail 104 is slid horizontally onto the mounting clips 106.

Turning now to FIG. 4, FIG. 4 is a cross-sectional front perspective view of the horizontal wall rail 104 of the sub-frame assembly 102 taken along line A-A of FIG. 1. The horizontal wall rail 104 includes on its rear or back side surface a channel 402 for receiving the modified dovetail 216 of the central mounting member 202 of the mounting clip 106. The channel 402, at its opening, includes downward and upward extending opposing lips 406 and 408 for engaging corresponding channels 230 (FIG. 2) in the modified dovetail 216 of the mounting clip 106. In this manner, the mounting clip 106 is mechanically locked to the horizontal wall rail 104 in a manner that prevents the horizontal wall rail 104 from being pulled away from the mounting clip 106. The horizontal wall rail 104 is otherwise unable to translate up, down, inwardly or outwardly, or rotate, with respect to the mounting clip 106. According, without fasteners, the horizontal wall rail 104 will stay linked together with the mounting clip 106.

Those skilled in the art will recognize that other connections may be utilized to mount the horizontal wall rail 104 to the mounting clip 106 and the invention should not be limited to the mounting mechanism illustrated. For example, the horizontal wall rails 104 may be fastened on the central mounting member 202 through fastening devices, clips or other connectors. However, the use of a channel and grove system such that that illustrated can be desirable as it allows the parts to move relative to one another without coming apart. This, along with the pivotal connection of the mounting clips 106 to the studs 108 helps facilitate the horizontal wall rails 104 to remain plumb as the studs bow, warp or move due to moisture or settling.

The horizontal wall rail 104 also includes a mounting member for retaining the panel frame on the horizontal wall rail 104. In the illustrated example, the mounting member is positioned on the upper end of the horizontal wall rail 104 as an angled flange member 404. As explained further below, the angled flange member 404 extends upward for engagement with a corresponding channel 702 (FIG. 7) in the panel frame assembly 602. The angled member 404 retains the panel frame assembly 602 against the sub-frame assembly 102. Further, both the angled flange member 404 and the channel 402 include flat surfaces 410, 412 respectively, on the front of the horizontal wall rail 102 to provide a flat mounting surface for the panel frame assembly 602 when positioned on the horizontal wall rails 104.

FIG. 5 is a rear perspective review of the sub-frame assembly 102 illustrating the horizontal wall rail 102 engaged with a mounting clip 106. FIG. 5 best illustrates the interconnection between the mounting clip 106 and the horizontal wall rail 104. As can be seen in FIG. 5, the modified dovetail 216 of the mounting clip 106 slides within the channel 402 of the horizontal wall rail 104. The downwardly extending lip 406 of the channel 402 engages against the channel 230 (FIG. 2) in the modified dovetail 216. Similarly, the lower channel 230 is engaged by the upwardly extending lip 408 of the channel 402 of the horizontal wall rail 104.

FIG. 6 is a perspective view of a tub and shower unit 100 having all the drywall and tile surrounding the tub 110 removed illustrating the sub-frame assembly 102 of the vertical wall mount system of the invention mounted to the sub-frame assembly 102 along the rear wall of the unit 100. The panel frame assembly includes two subcomponents: the panel frame 602 and the panel 1000. As illustrated in FIG. 6, the panel frame 602 includes perimeter side rails 604 and horizontal panel rails 606. The horizontal panel rails 606 include both upper and lower perimeter rails 610, as well as interior panel rails 608. The interior panel rails 608 interconnect with, or mount on, the horizontal wall rails 104 of the sub-frame assembly.

Figure 7:
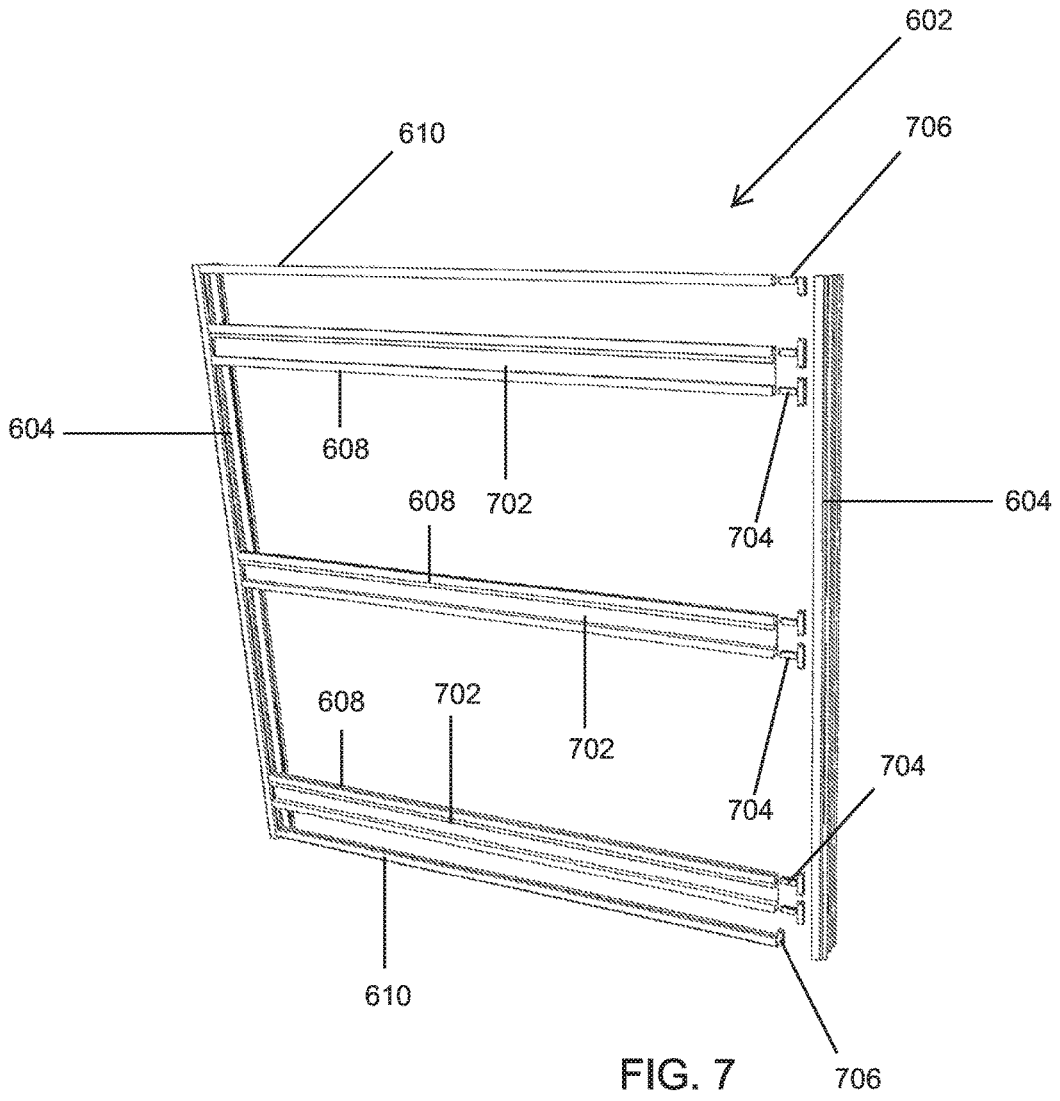
FIG. 7 is a rear view of the panel frame with one vertical perimeter side rail removed.

FIG. 7 is a rear view of the panel frame 602 with one vertical perimeter side rail 604 removed. As illustrated, the rear or back side of the interior panel rails 608 include a channel 702 created by a downwardly extending flange for engagement of the angled flange 404 of the horizontal wall rail 104 (See FIGS. 9*a*, 9*b* and 9*c*). The perimeter side rails 604 can be connected to the panel rails 608, 610 in a variety of manners. In one example, as illustrated in FIG. 7, L-shaped 706 and T-shaped 704 frame connectors may be utilized. The use of the L-shaped 706 and T-shaped 704 frame connectors are discussed in further detail below in connection with FIGS. 8A and 8B.

Further, the perimeter side rails 604 can be connected to or positioned adjacent one another (panel to panel) in a linear fashion or to create a corner connection in a variety of different ways. For example, male-to-female connections, tongue and groove connections, snap-lock connections, pivotal type connections, frictional fit connections or any number of other types of connections can be used to connect one panel to another panel at its perimeter. The connections can also utilize gaskets at their interface to provide an added layer of waterproofing. One example of a type of corner connection that allows for pivotal movement between two panels yet maintains a waterproof seal will explained and illustrated further below. Those skilled in the art will recognize that this connection is only an example of one type of connection.

Figure 8A:
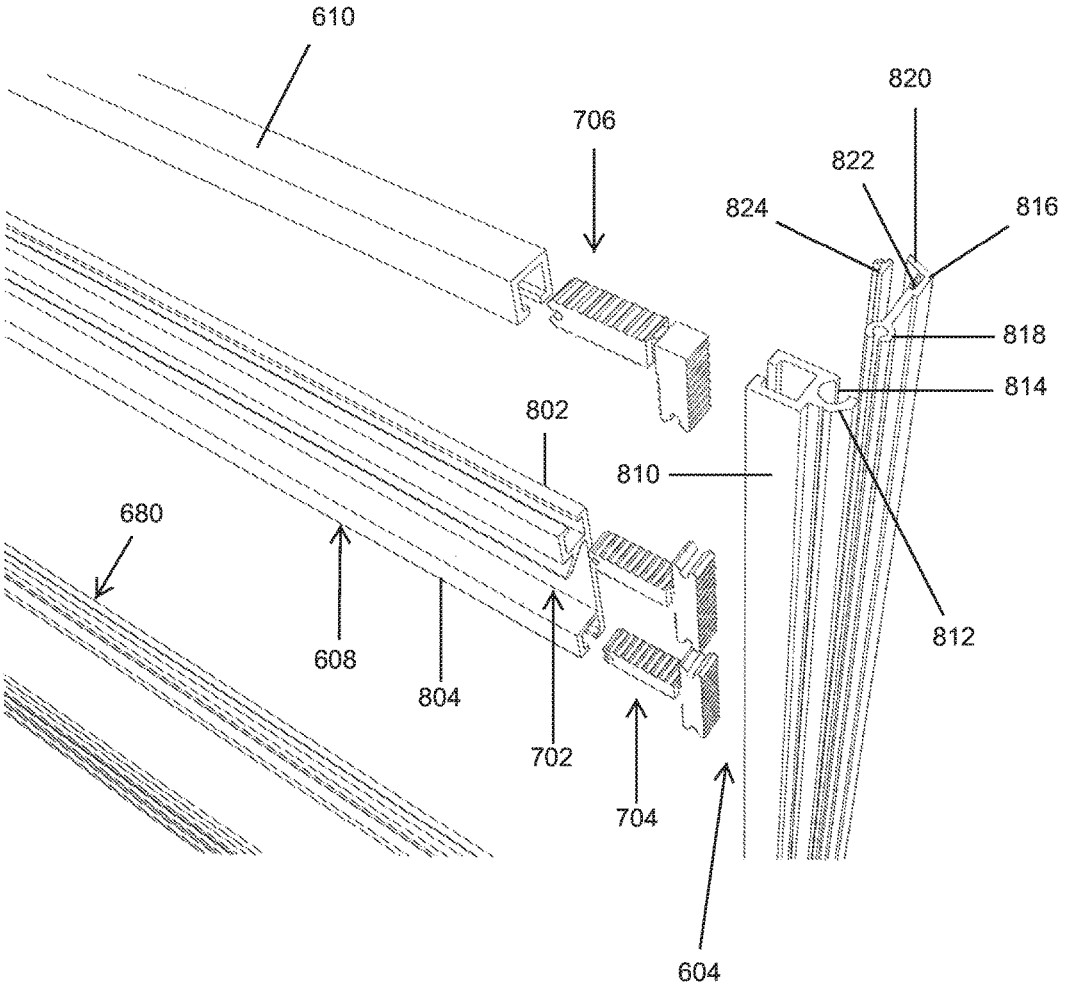
FIG. 8*a* is an exploded rear perspective plan view of the panel frame illustrating the connection of a pivoting vertical perimeter side rail to horizontal panel rails of a panel frame.
Figure 8B:
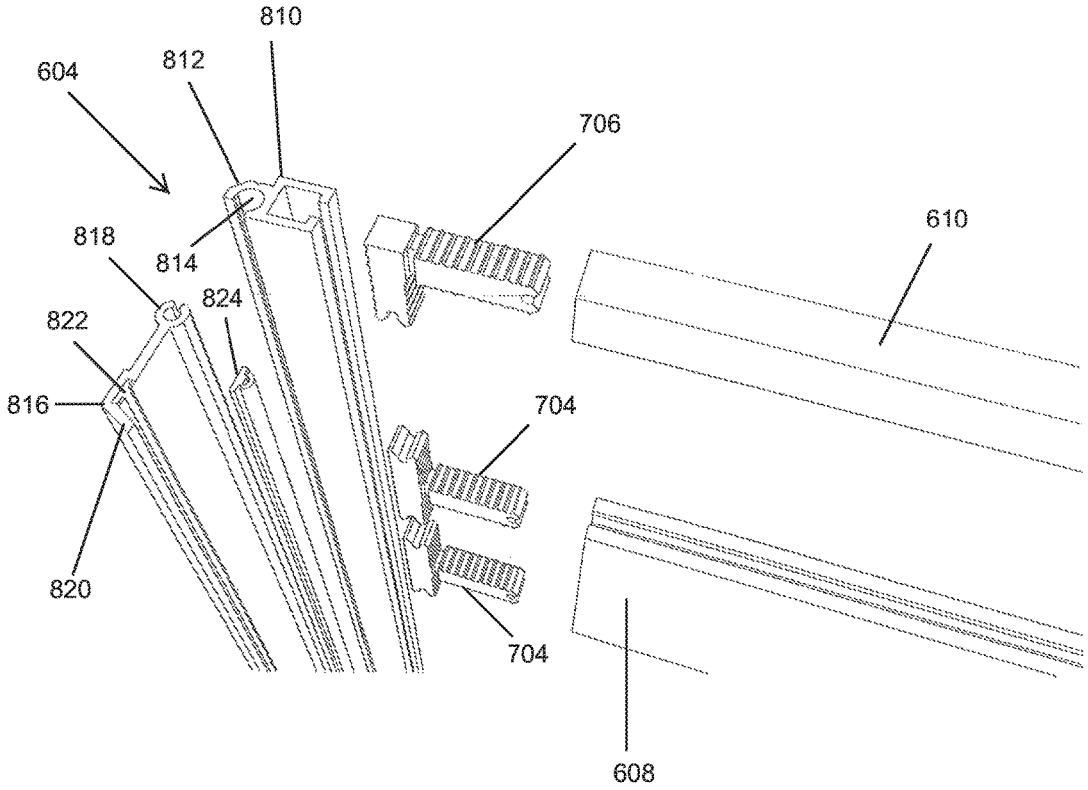
FIG. 8*b* is an exploded front perspective plane view of the panel frame illustrating the connection of a pivoting vertical perimeter side rail to horizontal panel rails of a panel frame

FIGS. 8*a* and 8*b* illustrated exploded rear and front plan perspective views of a panel frame 602 illustrating the interconnection of a panel frame 602 and the use of pivotal type perimeter side rail. Frame clips 704 and 706 enable the connection of the horizontal panel rails 610 and 608 to the perimeter side rails 604 to form the panel frame 602. Accordingly, aluminum frames may be interconnected at certain intersections via the frame clips 704 and 706. Square channels or chamber having openings at the ends of the frame members, including both the horizontal panel rails and perimeter side rails may be utilized by the frame clips 704 and 706 to secure the parts of the panel frame 602 together. The frame connectors 706 and 704 are designed to slide into any of these square openings and be secured at its end by fasteners once in place. The channels or chambers of the panel frame components 604, 608, 610 secure, for example, in perpendicular alignment with one another utilizing the framing clips 704 and 706. The framing clips 704 and 706 have screw ports located at the distal ends of each projection of the clip 704 and 706. Each clip projection is then designed to engage a screw and fasten the clip against a panel frame member. The notches or ridges on the sides of the frame clips 704 and 710 allow the clips 704 and 710 to slide freely and be position anywhere along the panel framing member before secured by the fasteners.

Also illustrated in FIG. 8A is a perimeter side panel design 810 that allows for the pivotal connection of a corner bracket 816 that inter connects with adjacent panels. The perimeter side panel 810 includes a finger like protrusion 812 forming a circular channel 814 for creating a pivotal connection with the corner bracket 816.

The corner bracket 816 includes, at one end, a rod member 818 that interconnects with the circular channel 814 of the perimeter side rail 810 to create a pivotal connection. Corner bracket 816 further includes a central channel 822 for receiving a gasket 824 to create a waterproof seal and an angled extension 820 for interfacing with adjacent perimeter side rails of panel frame members.

Figure 8C:
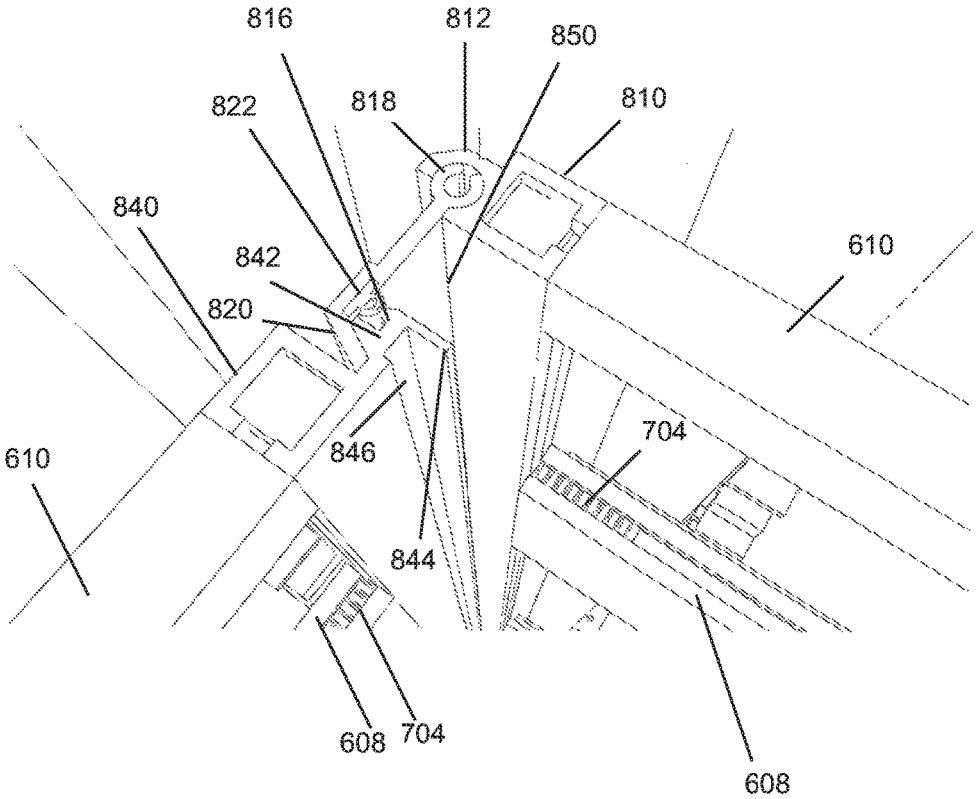
FIG. 8*c* is a front plan perspective view of the pivoting vertical perimeter side rail of a panel frame connected to a vertical perimeter corner side rail.

FIG. 8*c* is a front plan perspective view of the pivoting vertical perimeter side rail 810 of a panel frame 602 connected to a vertical perimeter corner side rail 840 of an adjacent panel frame member. FIG. 8C shows one example of how the panel frame members 608 may be interconnected at a corner in a pivotal manner and that provides for a waterproof connection at the corner intersection. Two Panels frames 608 are connected to perimeter side rails 810 and 840 respectively. The perimeter side rail 810, as previously explained, includes a fingerlike projection 812 forming a circular channel for a pivotal connecting to a corner bracket 816. Corner bracket 816 is pivotally connected to the perimeter side rail 810 at one end by a rod member 818. The opposing end of the bracket 816 includes a channel for gasket 822 to be positioned therein. The opposing perimeter side rail 840 includes a flange 844 for sitting against the gasket 822 to create a waterproof seal. The flange 844 also includes a channel opening 842 to receive the panel portion of the adjacent panel frame. Once the panels are positioned adjacent one another to create a corner, epoxy seal can placed in the corner to create another layer of waterproofing.

FIG. 9*a* is a cross-section of a horizontal wall rail 104 aligned with a horizontal panel rail 608 prior to placement of the panel frame assembly 602 on the sub-frame assembly 102. To align the panel frame assembly 602 for positioning on the sub-frame assembly 102, the channel 702 is aligned just above the angled flange 404 of the horizontal wall rail 104. The cross-section of the horizontal panel side rail 608 shows the downwardly extending channel 702 created by flange 904 mounting on the horizontal wall rail 104. As previously discussed, the horizontal wall rail 104 includes an upward extending flange 404 that interfaces and interconnects with the downward extending channel 702 created by flange 902 on the rear side of the panel rail 608.

FIG. 9*b* is a cross-section of the horizontal panel rail 608 of the panel frame as it is being placed upon the horizontal frame rail 104 of the sub-frame assembly 102. The interconnection between the upwardly extending flange 404 of the horizontal wall rail 104 is seen as the panel rail 608 contacts with the horizontal wall rail 104. In operation, the panel rail 608 is positioned above the horizontal wall rail 104 as illustrated in FIG. 9A and then positioned downward and slid across the flange 404 of the horizontal wall rail 104 such that the flange member 404 is positioned underneath the end and within the channel member 702 of the panel rail 608 created by the downward extending flange 902

FIG. 9*c* is a cross-section of the horizontal panel rail 608 of the panel frame 602 placed on the horizontal wall rail 104 of the sub-frame assembly 102. The mount of the panel rail 608 on the horizontal wall rail 104 is a removable mount. As illustrated, the horizontal wall rail 104 interconnects into the channel 702 of the panel mount such that the panel rail 608 may be reinstalled or easily removed from the horizontal wall rail 104 by lifting the panel rail 608 upward off of the horizontal wall rail 104. This mount is accomplished without fasteners but is a very secure and strong mounts that prevents the downward, rearward or forward movement of the panel rail 610 relative to the horizontal wall rail 104.

FIG. 10 is an exploded plan perspective view of one example of a panel frame assembly 1000. The panel frame assembly, when creating a tile panel frame, for example, will have four main component parts: (i) panel frame 602, (ii) mounting board 1002, such as a polycarbonate sheet, (iii) an adhesive sheet for secure the tile 1006 to the mounting board 1002 and (iv) tile 1006. The panel itself is constructed of the mounting board 1002 and anything affixed to the mounting boards, such as the adhesive and tile. Panel or mounting board 1002 may be secured directly to the panel frame by adhesive, fasteners, or other known methods.

It should be noted that the system of the invention is not limited to the use of polycarbonate sheets. Polycarbonate is one particular wall material that is suitable for use because it is commercially available in either single or double wall forms where one wall has a decorative exterior pattern (i.e. simulated tiles) or finish. Polycarbonate is also a suitable material because it is available in translucent grades which allow for the walls of a room to be back-light. Other materials are also suitable. In the case of shower or bath tub enclosures, any rigid material which is waterproof or can be made waterproof is suitable. For interior walls where it is desired that the walls be removably replaceable and water intrusion is not a concern, most conventional wall material is suitable.

To complete the assembly of the vertical wall mount system, the panel frame assembly 1000 is mounted on the sub-frame assembly 102. FIG. 11 is a perspective view of a tub and shower unit 100 showing how it would appear having a tiled panel frame assembly 1000 installed on the sides walls of the tub 110 utilizing the vertical wall mount system of the invention.

FIG. 12 illustrates the sub-frame assembly 102 being mounted to the studs 108 surround a tub 110 utilizing a basic installation tool 1200. The installation tool 1200 is used to assist with installing the horizontal wall frames true, square and plumb and with relative ease to a stud wall. Utilizing an installation tool 1200 or 1500 (FIG. 15), greatly speeds up the process of installing the sub-frame assembly 102 on the wall frame.

FIG. 13 is a rear perspective view of the top portion of the basic installation tool 1200. The installation tool 1200 is basically a corner bracket having mounting members located at predetermined distances along the mounting tool for supporting the horizontal wall rails 104. The mounting bracket 1200 further includes holes 1204 above the mounting members for securing the horizontal wall rails 104 to the installation tool 1200 using fasteners 1206.

FIG. 14 illustrates a back view of the sub-frame assemble 102 being mounted on the studs 108 surrounding the tub 110 utilizing a basic installation tool 1200. As illustrated, the horizontal wall rails 104 are positioned on the mounting members 1202 of the basic installation tool 1200. Generally two or more installation tools are utilized to the mount the sub-frame assembly 102, but at least using one tool on opposing ends of the rail. The mounting clips 106 are then slid onto to the rear of the horizontal wall rails 106, one positioned on each side of a stud, but between two studs. The installation tool 1200 with the horizontal wall rails 104 secured thereto can then be position against the frame of the shower. Once positioned against the frame of the shower, the leveling of the wall rails can be checked and the positioning of the installation tool 1200 may be adjusted using shims or other mechanisms to raise or lower the horizontal wall rails 104 for leveling purposes. Once aligned, the mounting clips 106 may then be slid against the studs for securing to the studs. Clips may be used in the interim to hold certain parts in place while level, square and plumb of the sub-frame assembly is checked and verified prior to final installation.

As mentioned above, to align the mounting clips 106 in the right location, the clips 106 are installed and positioned along the horizontal wall rail 104 such that they are positioned between the studs of the frame. In this regard, there will be a clip for each stud that can be moved into position by simply sliding the mounting clip 106 toward the stud.

Figures 15A, 15B:
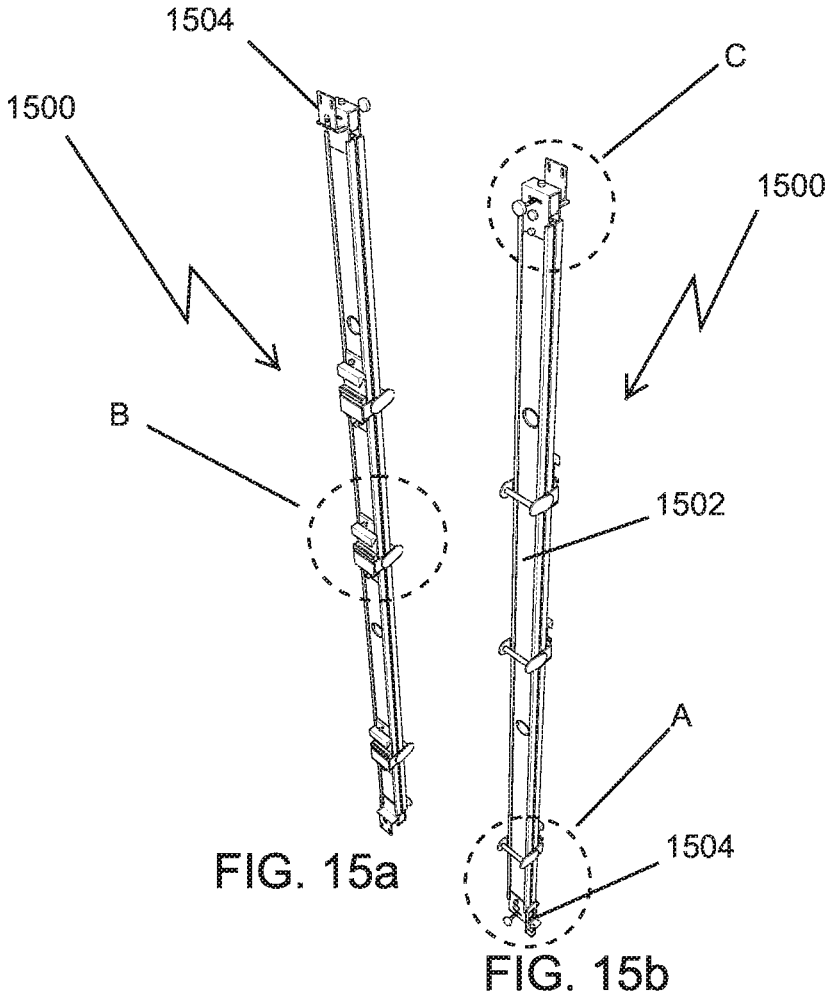
FIG. 15*a* illustrates a front perspective view of one example of an enhanced installation tool.
FIG. 15*b* illustrates a rear perspective view of one example of an enhanced installation tool.

FIGS. 15*a* and 15*b* illustrates a front and back perspective view of one example of an enhanced installation tool. The tool 1500 comprises a double channel aluminum rail 1502. At each end of the rail are adjustment heads 1504, which allow each end of the rails to translate in three directions. Therefore, through the use of the translation controls and spirit levels, the rail 1502 may be adjusted in three directions until it is true, square and plump with the studs 108 of a rough framed wall. The spirit levels may optionally be either built into the installation tool 1500 or attached to the installation tool 1500.

Figure 18:
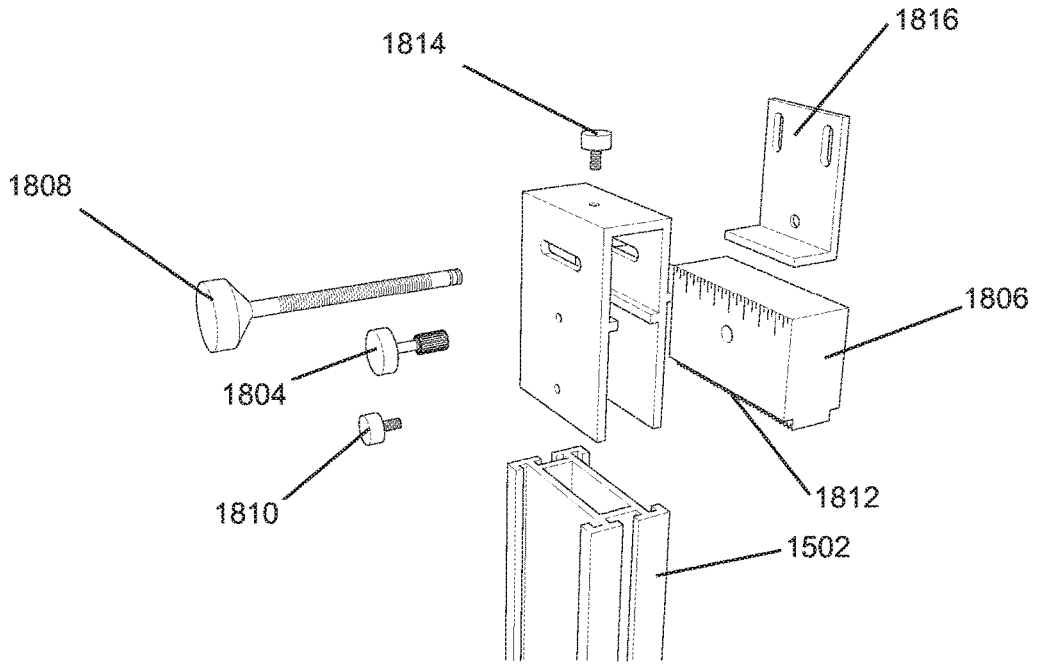
FIG. 18 is a close-up view of the encircled portion C of FIG. 15*b*, which illustrates one top adjustment portion of the enhanced installation tool of FIG. 15*b*.

The tool 1500 allows for adjustments at three general locations. At the top end, the bottom end and in the central region. FIG. 16 is a close-up view of the encircled portion A of FIG. 15*a*, which illustrates one bottom end adjustment portion of the enhanced installation tool of FIG. 15*b*. FIG. 17 is a close-up view of the encircled portion B of FIG. 15*a*, which illustrates one central adjustment portion of the enhanced installation tool of FIG. 15*a*. FIG. 18 is a close-up view of the encircled portion C of FIG. 15*b*, which illustrates one top adjustment portion of the enhanced installation tool of FIG. 15*b*.

With reference to FIG. 1, a rough framed wall may often be out of true, i.e. the studs which form the wall may be not be aligned vertically, may be spaced or angled inwardly or outwardly from each other in one transverse direction, and again may be spaced or angled inwardly or outwardly from each other in the other transverse direction. It is not uncommon for studs in rough framed wall to be out of true by ⅛ to ¼ inch and in extreme cases, more. This degree of out of true is more than sufficient to cause cracking in a prefabricated, tile or other decorative wall. Therefore, the horizontal wall rails 104 must be installed true relative to the studs 108 of the wall.

In installing the horizontal wall rails 104, two installation tools 1500 are first installed at each corner of the wall to be framed. The height of the adjustment tools 1500 may be roughly set relative to one another by means of set screw 1710 (FIG. 17). Referring now to FIG. 16, the installation tool includes a height adjustment mechanism 1602 which is attached with fasteners 1608 at die bottom of die tool rail 1502. The height adjustment mechanism 1602 allows for precision height adjustment of the installation tool 1500. The height adjustment mechanism comprises a plate 1604 with an outwardly extending flange 1606. Attached to the underside of the flange 1606 is a threaded block 1608. Adjustment screw 1610 may be rotated clockwise or counterclockwise, respectively to raise the height of the installation tool 1500 relative to the block 1608. It is desirable that the upper adjustment heads of both tools be at the same height.

With the axial alignment or height of the installation tools 1500 adjusted relative to one another, the installation tools 1500 must then be adjusted to be true, relative to the studs, in both transverse directions. One transverse direction is defined by the plane of the wall formed by the studs. The other transverse direction is perpendicular to the plane of the wall.

To adjust the adjustment tools 1500, so that they are true to the plane of the wall, a user adjusts screw 1804 (see FIG. 18) which engage the teeth 1812 in block 1806. This adjustment allows the tool 1500 to moved side-to-side within the plane formed by the wall studs 108. The lower adjustment head 1504 is the mirror image of the upper adjustment head 1504, thus both ends of the tool may be moved side-to-side within the plane of the wall until the tool is true or plump in the vertical with respect to the plane of the wall. Once the desired degree of adjustment has been obtained, the adjustment block 1816 can be prevented from any inadvertent side-to-side movement by means of a set screw 1814 which locks the block into position with respect to side to side movement.

The last remaining adjustment is the degree of trueness of the installation tools in the plane perpendicular to the plane of the stud wall. In this instance the tool can be moved in and out with respect to the perpendicular plane by turning adjustment screw 1808. Adjustment screw 1808 passes through the first slot 1820 in adjustment head 1822. Located within the head is adjustment block 1806. In center of the block 1806 is a threaded hole 1824. Adjustment screw 1808 is threaded into hole 1816 until it extends through the second slot 1820 in the adjustment head 1822 and passes through clearance hole 1810 in clip 1816. The adjustment screw 1808 includes grooves 1830 to which cir-clips or e-clips may be attached after the grooves protrude through the clearance hole 1810. Clip 1816 is slidably fixed to the adjustment head 1822 and is temporarily attached to a corner or other stud 108 for the purpose of alignment of the adjustment tool 1500. Turning adjustment screw 1808 counter clockwise or clockwise causes the adjustment tool 1500 to be moved inwardly or outwardly with respect to the plane perpendicular to the plane of the wall.

When all of the above adjustments have been made, the adjustment tools 1500 will point strait up with no lean in any transverse plane. At this point, horizontal wall rails 104 may be loaded into the adjustment tool 1500 via spring loaded clamps 1700 which are vertically spaced along the tool 1500 rail 1502. FIG. 17 is a close-up view of the encircled portion B of FIG. 15*a*, which illustrates one central adjustment portion of the enhanced installation tool of FIG. 15*a*.

Clamps 1700 comprise a slide plate 1704 which fits within a channel 1720. The plate includes a set screw 1706 that may be used to lock each individual clamp assembly 1700 at a predetermined height. Attached at an upper end of the clamp assembly is a block 1708 which duplicates the upper interface of the second horizontal wall frame 104 to which the first horizontal wall framing 104 mates. The clamp assembly also includes a lower clamp block 1810 which supports the first wall frame 104.

Prior to loading the clamps 1700 with a horizontal wall rail 104, the mounting clips 106 are slid onto wall rails 104, one such assembly for each stud 108 on the wall to be framed. Once a horizontal wall rail is loaded onto the plurality of clamps 1700, lever 1712 is rotated upwardly to pull the lower clamp block 1710 into the wall rail 104 and thereby locks the framing rail 22 into place. The lever 1712 uses a cam lobe to achieve its locking action. Thereafter, the mounting clips 106 are slid up against the sides of the wooden studs and are attached to the studs via mechanical fasteners.

The vertical wall mount system of the enables new technology to be integrated into wall or other vertical services in both a wet and a dry environment. As the system creates a waterproof environment, electronics can be built into the system and positioned behind the panels. This could include, but not be limited to light, televisions, speakers, computers, tablets, readers, speakers, infotainment systems, etc. The possibilities are rather limitless.

As illustrated above, in operation, the panel frame assembly is easily removed from the sub-frame assembly such that the walls may be easily removed and replaced if owner desires to remodel a bathroom, access the interior of the wall to run new wiring or plumbing, or to replace a damaged panel. Further, because mounting sheet may allow light to transmit through the sheet and because the system is waterproof, it is easy to backlight the translucent polycarbonate walls of the invention, thus providing illuminating glass tiles. This can be done by using low voltage multi-color LED lighting strips with a remote control, for example.

Because the panels are prefabricated, the system further provides a means of prefabricating, testing and anchoring the plumbing connections and fixtures used in a bathroom to perfectly align with matching cutouts in the prefabricated tile panels. This reduces potential for costly leaks and further reduces costs in that less plumbing time is required.

As noted above, because everything is prefabricated and the environment is waterproof, the ability to add additional features to the panel assembly or in the wall behind the panel assembly is endless. Additional features include the ability to readily affix and waterproof a viewing window for a television or computer screen directly into a wall panel or on the structure behind the panel whereby the screen can be hidden by electro-chromatic glass when not being used. Similarly, a shaving mirror with LED lights down each side can be implemented into the panel and also be hidden by electro-chromatic glad. Pre-fabricated niches with optional top mounted LED lights and/or hidden dispensers for shampoo etc. can be added with ease. The hidden liquid dispensers would be located directly above the recessed niches and be mounted on a small frame whereas the bottom of the dispenser's frame makes up the top of the recessed niche. To refill the dispensers a portion of the dispenser's frame would be able to slide down to access and refill the dispensers. Recessed U-channels in the panels flush to the surface that provides an easy and hidden means of securing stationary panels of heavy glass shower enclosures is also possible, as well as the ability to place a waterproof LED lighting strip (protected by a thin translucent membrane) inside the U-channels described above to illuminate the glass panels from their edge. This will illuminate the exposed polished edges of the glass, non-clear laminate films, decorative sand blasted designs etc.

LED lights may also be implemented inside other heavy glass hardware such as frameless shower door hinges, clips and glass standoff clips. These LED lights will illuminate the edge of the glass for the same purposes mention above.

The panels may further be constructed to accommodate numerous types of accessories including, but not limited to: bathroom stalls, heavy glass shower hinges, clips and headers, wall mounted sinks, grab rails etc. by bolted connections rather than expansion anchors. This can be done by securing metal plates behind the panels in the location where an accessory will attach. The plates can have projections through predrilled holes in the panel at the bolt locations that are flush with the surface. The projections can be drilled and tapped to allow an anchoring bolt to secure with ease. Additionally, the back-up plates can have a flat plate or clip that protrudes all the way through the finished surface as a means to secure various accessories such as a shower header.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A shower panel assembly for mounting a shower panel to vertical studs of a wall frame, the shower panel assembly comprising:

a shower panel having a front side and a generally flat rear side, where the shower panel has a decorative surface on the front side of the panel;

at least one rail having a rear channel and a front surface, where the front surface of the at least one rail is directly attached to the generally flat rear side of the shower panel; and at least two mounting clips, each having a front mounting member, each of the at least two mounting clips mounted on at least one vertical stud such that the mounting clips mounted on adjacent studs are in horizontal alignment with one another, wherein each of the at least two mounting clips is secured to each vertical stud such that the front mounting member of each of the at least two mounting clips pivots horizontally along the wall frame after the at least two mounting clips are secured to the vertical studs, and wherein the front mounting member fits within the rear channel of the at least one rail engaging the rear channel of the rail and allowing the shower panel to pivot in a horizontal direction after the shower panel assembly is assembled.

2. The assembly of claim 1 where the shower panel assembly includes opposing perimeter side rails mounted on the rear surface of the shower panel and where the at least one rail is a horizontal rail mounted on the rear surface of the decorative shower panel extending perpendicular to, and between, the opposing perimeter side rails.

* * * * *